US008023863B2

(12) United States Patent
Hayashi et al.

(10) Patent No.: US 8,023,863 B2
(45) Date of Patent: Sep. 20, 2011

(54) CHARGING APPARATUS AND IMAGE FORMING APPARATUS

(75) Inventors: Rika Hayashi, Nara (JP); Toshiaki Ino, Kyoto (JP); Masanobu Yamamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 468 days.

(21) Appl. No.: 12/275,633

(22) Filed: Nov. 21, 2008

(65) Prior Publication Data

US 2009/0136261 A1 May 28, 2009

(30) Foreign Application Priority Data

Nov. 22, 2007 (JP) ..... P2007-303599

(51) Int. Cl.
*G03G 15/02* (2006.01)

(52) U.S. Cl. ..... 399/171; 399/170; 399/173

(58) Field of Classification Search ..... 399/170, 399/171, 173
See application file for complete search history.

(56) References Cited

U.S. PATENT DOCUMENTS

| | | | | |
|---|---|---|---|---|
| 6,208,499 | B1 | 3/2001 | Yonekawa et al. | |
| 7,302,211 | B2 | 11/2007 | Deguchi et al. | |
| 2006/0062596 | A1 * | 3/2006 | Deguchi et al. | 399/171 |
| 2007/0217822 | A1 | 9/2007 | Deguchi et al. | |

FOREIGN PATENT DOCUMENTS

| | | | |
|---|---|---|---|
| JP | 61-174567 | | 8/1986 |
| JP | 5-94914 | A | 4/1993 |
| JP | 5-205850 | A | 8/1993 |
| JP | 7-028299 | | 1/1995 |
| JP | 11-40316 | A | 2/1999 |
| JP | 2005-61480 | A | 3/2005 |
| JP | 2006-113531 | | 4/2006 |
| JP | 2006-201488 | | 8/2006 |
| JP | 2007-256394 | A | 10/2007 |
| JP | 2007-256396 | | 10/2007 |

* cited by examiner

*Primary Examiner* — David M Gray
*Assistant Examiner* — G. M. Hyder
(74) *Attorney, Agent, or Firm* — Nixon & Vanderhye, P.C.

(57) ABSTRACT

A charging apparatus is provided in which electrodes can be protected from corrosion induced by water content in the air, ozone, nitrogen oxide and the like and thereby lack of uniformity in charged potential on photoreceptor surface can be prevented, and in which a charged potential on photoreceptor surface can be kept in an adequate range for a longer period of time. As an electrode disposed in the charging apparatus for charging photoreceptor surface, an electrode formed with a protective layer made of nickel and phosphorus for surface protection is used. In the protective layer, phosphorus concentration and thickness proportion are each set to fall within a specified range.

18 Claims, 4 Drawing Sheets

CHARGING APPARATUS AND IMAGE FORMING APPARATUS

CROSS-REFERENCE TO RELATED APPLICATION

This application claims priority to Japanese Patent Application No. 2007-303599, which was filed on Nov. 22, 2007, the contents of which are incorporated herein by reference in its entirety.

BACKGROUND OF THE INVENTION

1. Field of the Invention

The present invention relates to a charging apparatus and an image forming apparatus.

2. Description of the Related Art

In an electrophotographic image forming apparatus such as a copier, a printer, and a facsimile machine, as an image carrier, a photoreceptor having a photosensitive layer containing a photoconductive substance formed on its surface is used. In this construction, after the surface of the photoreceptor is uniformly charged under application of electric charge, an electrostatic latent image corresponding to image information is formed thereon through various image-formation process steps. Then, this electrostatic latent image is developed into a visible image with use of a developer containing toner that is supplied from a developing section. The visible image is transferred onto a recording material such as paper, and is fixed into place under application of heat and pressure by a fixing roller. In this way, an image is formed on the recording material.

In such an image forming apparatus, a charging apparatus is used for charging the surface of the photoreceptor. In general, the charging apparatus is composed of: a discharging electrode for conducting corona discharge; a grid electrode to which is applied an appropriate voltage, for controlling the amount of charge applied to the surface of the photoreceptor by a charging electrode and thus controlling the charged potential on the surface of the photoreceptor; and a support member for supporting the charging electrode and the grid electrode. As the grid electrode, a wire grid electrode formed of stainless steel, tungsten, or the like, a porous platy grid electrode constructed by creating a large number of through holes in a metal plate formed for example of stainless steel (grid substrate) and the like can be used.

Among the grid electrode as mentioned just above, the wire grid electrode is susceptible to adhesion of contaminants such as toner. Due to the deposition of contaminants, the capability of controlling the charged potential on the surface of the photoreceptor becomes insufficient, thus causing lack of uniformity in the charged potential on the surface of the photoreceptor.

On the other hand, being formed of an iron-based metal material such as stainless steel, the porous platy grid electrode exhibits high durability under normal circumstances. However, the negative side is that the porous platy grid electrode is prone to oxidation in the presence of water content under a high humidity environment, ozone and nitrogen oxide generated in accompaniment with corona discharge during charging operation, and the like. In the long-time use of the porous platy grid electrode, for example, operation under a high humidity environment and contact with ozone and nitrogen oxide are inevitable. Therefore, in the porous platy grid electrode formed of a metal material such as stainless steel, corrosion such as rust occurs due to water content in the air, ozone, nitrogen oxide, and the like, and nitrogen oxide is deposited on the surface thereof, in consequence whereof there results durability deterioration. In addition to that, the capability of controlling the charged potential on the surface of the photoreceptor becomes insufficient, thus causing lack of uniformity in the charged potential on the surface of the photoreceptor. This makes it impossible to constantly impart desired charged potential to the surface of the photoreceptor with stability.

In view of the problems associated with such a grid electrode, for example, Japanese Unexamined Patent Publication JP-A 2006-113531 discloses a charging apparatus characterized in that its porous platy grid electrode has a nickel plating layer containing polytetrafluoroethylene (PTFE) fine particles formed on at least one surface thereof. The charging apparatus disclosed in JP-A 2006-113531 employs a grid electrode constructed by forming, on a surface of a porous platy grid electrode, a PTFE fine particle-containing nickel plating layer (hereafter referred to as "nickel PTFE composite plating layer" unless otherwise specified) by means of electroless plating. The grid electrode having the nickel PTFE composite plating layer has the advantage of being inexpensive compared to a grid electrode having a gold plating layer.

However, in the grid electrode having the nickel PTFE composite plating layer, since the nickel PTFE composite plating layer includes heterogeneous components such as metallic nickel and organic fine particles PTFE, it follows that water content in the air, ozone and nitrogen oxide generated through discharge and the like. find their ways from the interface between nickel and PTFE particles to the surface of the grid electrode. This leads to oxidation of the surface of the grid electrode and thus to corrosion such as rust. As a result, the charged potential-control capability and the durability of the grid electrode still remain insufficient, thus causing lack of uniformity in the charged potential on the surface of the photoreceptor.

Meanwhile, as a discharging electrode for conducting corona discharge, a wire electrode, a metal plate electrode having a plurality of needle-like portions (hereafter referred to as "needle-like electrode"), and the like can be used. Among them, the use of a needle-like electrode is particularly desirable because of its advantages of requiring less number of constituent components, having longer service life, generating less amount of ozone, and suffering little from a break and ensuing malfunction. The needle-like electrode is constructed by performing etching on a metal plate mainly formed for example of an iron-based metal material such as stainless steel thereby to form a plurality of needle-like portions. An iron-based metal material such as stainless steel used as the material for forming the needle-like electrode exhibits high durability, but has a drawback that it is prone to oxidation in the presence of water content under a high humidity environment, ozone, nitrogen oxide and the like generated in accompaniment with corona discharge during charging operation. In the long-time use of the needle-like electrode, for example, operation under a high humidity environment and contact with ozone and nitrogen oxide are inevitable. Therefore, in the needle-like electrode formed of a metal material such as stainless steel, corrosion occurs due to water content in the air, and ozone and nitrogen oxide and the like, in consequence whereof there results durability deterioration. In addition to that, there arises deterioration in the capability of controlling a voltage which is applied to the needle-like electrode to induce corona discharge at the needle-like portions, thus causing lack of uniformity in the charged potential on the surface of the photoreceptor. This makes it impossible to constantly impart desired charged potential to the surface of the photoreceptor with stability.

Furthermore, also in the wire electrode, just as is the case with the needle-like electrode, there is a problem to be solved that ozone generated through corona discharge induces rust, corrosion, and the like, which results in lack of uniformity in the charged potential on the surface of the photoreceptor.

In view of the problems associated with such a discharging electrode for conducting corona discharge, for example, Japanese Unexamined Patent Publication JP-A 2006-201488 discloses a charging apparatus characterized in that its discharging electrode has a nickel PTFE composite plating layer formed on at least one surface thereof. In the charging apparatus disclosed in JP-A 2006-201488, the nickel PTFE composite plating layer formed on the surface of the discharging electrode is obtained by means of electroless plating, and the film thickness thereof is set at or above 0.3 μm. Accordingly, as compared with a nickel PTFE composite plating layer obtained by means of commonly-used electrolytic plating under DC current application, the nickel PTFE composite plating layer is dense and hard in layer structure, has less pinholes, exhibits film thickness uniformity even if it is made thin, and provides high adherence with respect to the discharging electrode.

However, in the discharging electrode having the nickel PTFE composite plating layer, since the nickel PTFE composite plating layer includes heterogeneous components such as metallic nickel and organic fine particles PTFE, it follows that water content in the air, ozone and nitrogen oxide and the like find their ways from the interface between nickel and PTFE particles to the surface of the discharging electrode. This leads to oxidation of the surface of the discharging electrode and thus to corrosion such as rust. As a result, the applied voltage-control capability and the durability of the discharging electrode still remain insufficient, thus causing lack of uniformity in the charged potential on the surface of the photoreceptor.

SUMMARY OF THE INVENTION

Accordingly, an object of the invention is to provide a charging apparatus in which electrodes can be protected from corrosion induced by water content in the air, ozone, nitrogen oxide, and so forth and thereby lack of uniformity in charged potential on photoreceptor surface can be prevented, and in which a charged potential on photoreceptor surface can be kept in an adequate range for a longer period of time. Another object of the invention is to provide an image forming apparatus that is capable of recording high-quality images for a longer period of time with the inclusion of the charging apparatus which enables a charged potential on photoreceptor surface to be kept in an adequate range for a longer period of time.

The invention provides a charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the grid electrode having a protective layer made of nickel and phosphorus for surface protection formed at least on its one surface, the protective layer fulfilling a following formula (1) and a condition of $8 \leqq x_1 \leqq 15$, $$(-0.7x_1+11) \leqq y_1 \leqq (-0.7x_1+27) \quad (1),$$

where a concentration of phosphorus in the protective layer is defined as $x_1$ (%) and a proportion of a one-surface thickness of the protective layer $Z_2$ to a thickness of the grid electrode $Z_1$ given as $(Z_2/Z_1)\times 100$ is defined as $y_1$ (%).

According to the invention, the grid electrode for controlling a charged potential on the surface of the photoreceptor has, on at least its one surface, a protective layer made of nickel and phosphorus for surface protection. The protective layer fulfills the following formula: $(-0.7x_1+11) \leqq y_1 \leqq (-0.7x_1+27)$ and a condition of $8 \leqq x_1 \leqq 15$. Since the protective layer which satisfies the condition of $(-0.7x_1+11) \leqq y_1$ is formed on the surface of the grid electrode, where the concentration of phosphorus in the protective layer is defined as $x_1$ (%) and the proportion of the one-surface thickness of the protective layer $Z_2$ to the thickness of the grid electrode $Z_1$ given as $(Z_2/Z_1)\times 100$ is defined as $y_1$ (%), it is possible to protect the surface of the grid electrode against corrosion caused by water content in the air, and ozone and nitrogen oxide and the like generated through discharge, as well as against occurrence of pinholes. In addition, deterioration in the charged-potential control capability of the grid electrode can be suppressed. Further, since the protective layer which satisfies the condition of $y_1 \leqq (-0.7x_1+27)$ is formed on the surface of the grid electrode, it is possible to suppress a decline in porosity of through holes created in the grid electrode, as well as to suppress deterioration in the charged-potential control capability of the grid electrode. Accordingly, the charged-potential control capability of the grid electrode can be maintained for a longer period of time, wherefore the charged potential on the surface of the photoreceptor can be kept in an adequate range for a longer period of time.

Moreover, by adjusting the concentration $x_1$ of phosphorus, which is a substance less prone to be combined with oxygen, in the protective layer to be higher than or equal to 8%, it is possible to protect the surface of the grid electrode against oxidation and ensuing corrosion. Moreover, in the case of forming the protective layer by means of plating, by adjusting the phosphorus concentration $x_1$ to be lower than or equal to 15%, it is possible to form the protective layer while avoiding considerable lowering of the pH value of a plating bath in use. Accordingly, ionization of nickel contained in the plating bath can be suppressed, wherefore the protective layer can be formed without fail.

Moreover, the invention provides a charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the discharging electrode having a protective layer made of nickel and phosphorus for surface protection formed at least on its one surface, the protective layer fulfilling a following formula (2) and a condition of $8 \leqq x_2 \leqq 15$, $$(-0.7x_2+11) \leqq y_2 \leqq (-0.7x_2+27) \quad (2),$$

where a concentration of phosphorus in the protective layer is defined as $x_2$ (%) and a proportion of a one-surface thickness of the protective layer $Z_4$ to a thickness of the discharging electrode $Z_3$ given as $(Z_4/Z_3)\times 100$ is defined as $y_2$ (%).

According to the invention, the discharging electrode for applying a voltage to the surface of the photoreceptor to effect charging thereon has, on at least its one surface, a protective layer made of nickel and phosphorus for surface protection made of nickel and phosphorus. The protective layer fulfills the following formula: $(-0.7x_2+11) \leqq y_2 \leqq (-0.7x_2+27)$ and a condition of $8 \leqq x_2 \leqq 15$, where the concentration of phosphorus in the protective layer is defined as $x_2$ (%) and the proportion of the one-surface thickness of the protective layer $Z_4$ to the thickness of the discharging electrode $Z_3$ given as $(Z_4/Z_3)\times100$ is defined as $y_2$ (%). Since the protective layer which satisfies the condition of $(-0.7x_2+11)\leqq y_2$ is formed on the surface of the discharging electrode, it is possible to protect the surface of the discharging electrode against corrosion caused by water content in the air and ozone, nitrogen oxide, etc. generated through discharge, as well as against occurrence of pinholes. In addition, deterioration in the applied-voltage control capability of the discharging electrode can be suppressed. Further, since the protective layer which satisfies the condition of $y_2\leqq(-0.7x_2+27)$ is formed on the surface of the discharging electrode, it is possible to avoid formation of an unduly thick protective layer on the discharging electrode, as well as to suppress deterioration in the applied-voltage control capability of the discharging electrode. Accordingly, the applied-voltage control capability of the discharging electrode can be maintained for a longer period of time, wherefore the charged potential on the surface of the photoreceptor can be kept in an adequate range for a longer period of time.

Moreover, by adjusting the concentration $x_2$ of phosphorus, which is a substance less prone to be combined with oxygen, in the protective layer to be higher than or equal to 8%, it is possible to protect the surface of the discharging electrode against oxidation and ensuing corrosion. Moreover, in the case of forming the protective layer by means of plating, by adjusting the phosphorus concentration $x_2$ to be lower than or equal to 15%, it is possible to form the protective layer while avoiding considerable lowering of the pH value of a plating bath in use. Accordingly, ionization of nickel contained in the plating bath can be suppressed, wherefore the protective layer can be formed without fail.

Moreover, the invention provides a charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the discharging electrode, as well as the grid electrode, having a protective layer made of nickel and phosphorus for surface protection formed at least on its one surface the protective layer fulfilling a following formula (3) and a condition of $8\leqq x_3\leqq15$, $$(-0.7x_3+11)\leqq y_3\leqq(-0.7x_3+27) \quad (3),$$

where a concentration of phosphorus in the protective layer is defined as $x_3$ (%) and a proportion of a one-surface thickness of the protective layer $Z_6$ to a thickness of the discharging electrode $Z_5$, as well as a thickness of the grid electrode $Z_5$, given as $(Z_6/Z_5)\times100$ is defined as $y_3$ (%).

According to the invention, the discharging electrode, as well as the grid electrode, has a protective layer made of nickel and phosphorus formed at least on its one surface for each surface protection. The protective layer fulfills the following formula: $(-0.7X_3+11)\leqq y_3\leqq(-0.7x_3+27)$ and a condition of $8\leqq x_3\leqq15$, where the concentration of phosphorus in the protective layer is defined as $x_3$ (%) and the proportion of the one-surface thickness of the protective layer $Z_6$ to the thickness of the discharging electrode $Z_5$, as well as the thickness of the grid electrode $Z_5$, given as $(Z_6/Z_5)\times100$ is defined as $y_3$ (%). Since the protective layer which satisfies the condition of $(-0.7x_3+11)\leqq y_3$ is formed on the surfaces of the discharging electrode and the grid electrode, it is possible to protect the surfaces of the discharging electrode and the grid electrode against corrosion caused by water content in the air and ozone, nitrogen oxide and the like generated through discharge, as well as against occurrence of pinholes. In addition, deterioration in the applied-voltage control capability of the discharging electrode and in the charged-potential control capability of the grid electrode can be suppressed. Further, since the protective layer which satisfies the condition of $y_3\leqq(-0.7x_3+27)$ is formed on the surfaces of the discharging electrode and the grid electrode, it is possible to prevent deterioration in the applied-voltage control capability of the discharging electrode and in the charged-potential control capability of the grid electrode. Accordingly, the applied-voltage control capability of the discharging electrode and the charged-potential control capability of the grid electrode can be maintained for a longer period of time, wherefore the charged potential on the surface of the photoreceptor can be kept in an adequate range for a longer period of time.

Moreover, by adjusting the concentration $x_3$ of phosphorus, which is a substance less prone to be combined with oxygen, in the protective layer to be higher than or equal to 8%, it is possible to protect the surfaces of the discharging electrode and the grid electrode against oxidation and ensuing corrosion. Moreover, in the case of forming the protective layer by means of plating, by adjusting the phosphorus concentration $x_3$ to be lower than or equal to 15%, it is possible to form the protective layer while avoiding considerable lowering of the pH value of a plating bath in use. Accordingly, ionization of nickel contained in the plating bath can be suppressed, wherefore the protective layer can be formed without fail.

Moreover, in the invention, it is preferable that the protective layer contains fluorinated organic fine particles.

According to the invention, the protective layer contains fluorinated organic fine particles. Accordingly, even if toner or the like adheres to the surface of the electrode, its adherability is so small that the adherent matter can be removed with ease.

Moreover, in the invention, it is preferable that at least one of the grid electrode and the discharging electrode is made of a metal material including stainless steel or titanium.

According to the invention, at least one of the grid electrode and the discharging electrode is made of a metal material including stainless steel or titanium. Accordingly, the grid electrode and/or the discharging electrode are/is excellent in electrical conductivity, durability, and corrosion resistance.

Moreover, in the invention, it is preferable that, the charging apparatus further comprises a pre-treatment layer interposed between the grid electrode and the protective layer, the pre-treatment layer being made of a conductive material that is formed by means of plating. Moreover, in the invention, it is preferable that, the charging apparatus further comprises a pre-treatment layer interposed between the discharging electrode and the protective layer, the pre-treatment layer being made of a conductive material that is formed by means of plating.

According to the invention, the charging apparatus further comprises a pre-treatment layer interposed between the grid electrode and the protective layer, as well as between the discharging electrode and the protective layer, the pre-treatment layer being made of a conductive material that is formed by means of plating. By using the pre-treatment layer as a conductive material, it is possible to enhance the adherability between the pre-treatment layer and the protective layer made of nickel and phosphorus, and thereby prevent the protective layer from peeling off at the interface between the pre-treatment layer and the protective layer.

Moreover, in the invention, it is preferable that the charging apparatus further comprises an after-treatment layer formed on the protective layer so as to cover the protective layer therewith, the after-treatment layer being made of a conductive material that is formed by means of plating.

Moreover, according to the invention, the charging apparatus further comprises an after-treatment layer formed on the protective layer so as to cover the protective layer therewith, the after-treatment layer being made of a conductive material that is formed by means of plating. Accordingly, even if pinholes are developed in the protective layer, the pinholes can be covered with the after-treatment layer. This helps prevent water content in the air, and ozone and nitrogen oxide and the like generated through discharge from finding their ways to the surface of the electrode through the pinholes. Moreover, by using the after-treatment layer as a conductive material to form, it is possible to enhance the adherability between the after-treatment layer and the protective layer made of nickel and phosphorus, and thereby prevent the after-treatment layer from peeling off at the interface between the after-treatment layer and the protective layer.

Moreover, the invention provides an image forming apparatus comprising:

a photoreceptor, on a surface of which is formed an electrostatic charge image;

the charging device for charging the surface of the photoreceptor;

an exposure section for forming an electrostatic charge image by applying signal light corresponding to image information to the surface of the photoreceptor in a charged state;

a developing section for forming a toner image by developing the electrostatic charge image borne on the surface of the photoreceptor;

a transfer section for transferring the toner image onto a recording material; and a fixing section for fixing the toner image transferred onto the recording material into place.

According to the invention, the image forming apparatus enables a charged potential on the surface of the photoreceptor to be kept in an adequate range for a longer period of time with the inclusion of the charging apparatus. Thus, the image forming apparatus is capable of recording high-quality images for a longer period of time

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
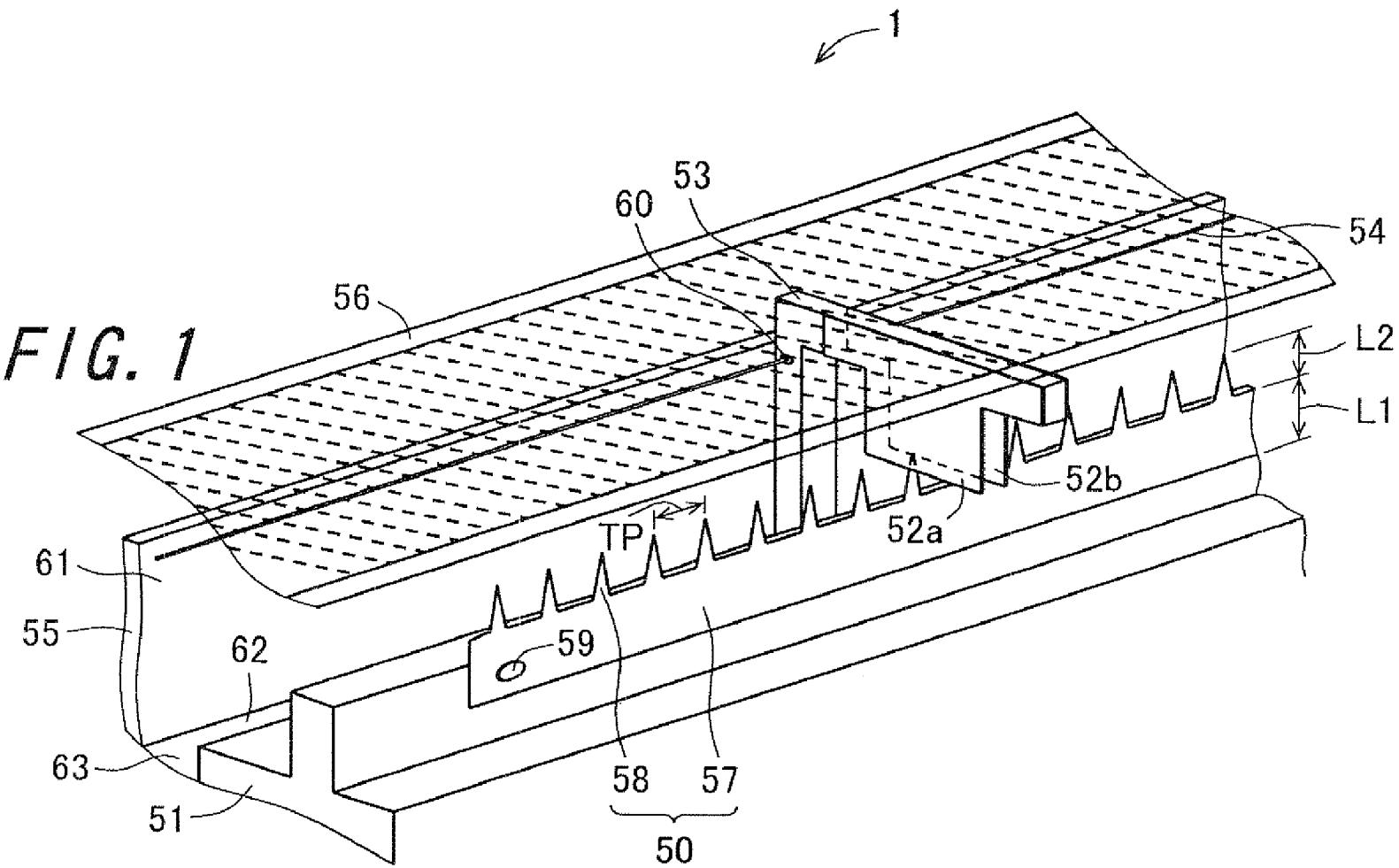
FIG. 1 is a perspective view showing the structure of a charging apparatus in accordance with one embodiment of the invention.

Now referring to the drawings, preferred embodiments of the invention will be described in detail.

FIG. 1 is a perspective view showing the structure of a charging apparatus 1 in accordance with one embodiment of the invention. The charging apparatus 1 is composed of: a platy electrode 50 having a plurality of pointed protrusions 58 (hereafter referred to as "needle-like like electrode 50"); a holding member 51 for holding the needle-like electrode 50; two pieces of cleaning members 52*a* and 52*b* disposed so as to be moveable relatively to the needle-like electrode 50, for cleaning the surface of the needle-like electrode 50 by grazing the needle-like electrode 50 during its movement; a support member 53 for supporting the cleaning members 52*a* and 52*b*; a moving member 54 for moving the cleaning members 52*a* and 52*b* and the support member 53; a shield case 55 for accommodating the needle-like electrode 50, the holding member 51, the cleaning members 52*a* and 52*b*, and the support member 53; and a grid electrode 56 for adjusting a charged potential on the surface of a photoreceptor.

In the charging apparatus 1, which is a so-called scorotron charger, corona discharge takes place upon application of voltage to the needle-like electrode 50 acting as a discharging electrode, so that the surface of a subsequently-described photoreceptor drum 11 can be charged. Moreover, upon application of a predetermined grid voltage to the grid electrode 56, the state of charging is made uniform throughout the surface of the photoreceptor drum 11. In this way, the surface of the photoreceptor drum 11 is charged to a predetermined potential with predetermined polarity. For example, in a toner mage forming section 2 provided in a subsequently-described image forming apparatus 100, the charging apparatus 1 is disposed face to face with the photoreceptor drum 11 along a direction axially of the photoreceptor drum 11.

The grid electrode 56 is disposed between the needle-like electrode 50 and the photoreceptor drum 11. Under application of voltage, the grid electrode 56 acts to control variation in the state of charging on the surface of the photoreceptor drum 11 thereby to make the charged potential uniform. As a base material for the grid electrode 56, a metal that can be processed into grid configuration and can be subjected to plating, for example, stainless steel, titanium, aluminum, nickel, copper, and iron, can be used. Among them, stainless steel is particularly desirable from the standpoint of improving the durability of the grid electrode 56. Note that titanium is known as a material having excellent corrosion resistance. It may be used as a grid after undergoing etching process. Specific examples of stainless steel include SUS304, SUS309, and SUS316. Among them, SUS316 is particularly desirable. Moreover, by performing masking and etching process on a metal plate, a plurality of through holes are created therein. The etching process can be carried out in accordance with a known method, for example, a method for spraying an etching solution such as an aqueous solution of ferric chloride to the metal plate. The metal plate in which are formed through holes by the chemical polishing process is subjected to water washing and acid cleaning or pure water cleaning in a water washing step, an acid dipping step, a water washing step, and a pure water dipping step, thereby to remove foreign matters from the surface of the metal plate. In this way, a grid electrode base in the form of a porous plate is obtained. In general, the porosity of the through holes formed in the grid electrode base is adjusted to be larger than or equal to 75%, and smaller than or equal to 85%.

In the first embodiment of the invention, the grid electrode 56 has, on at least its one surface, a protective layer made of nickel and phosphorus for surface protection. As a method for forming a protective layer on the surface of the grid electrode 56, for example, there is an electroless plating method such as a catalytic nickel plating method (Kanigen treatment). The grid electrode base is immersed in a plating bath heated to a bath temperature of 90° C. or above and is then subjected to electroless plating process. In this way, a protective layer can be formed on the surface of the grid electrode 56. As the plating bath for use in the electroless plating process, for example, there is an aqueous solution containing a hypophosphorus acid or a salt thereof and a nickel salt. Specific examples of the plating bath include "KANIFLON S" (product name) manufactured by Japan Kanigen Co., Ltd., "NIMUFLON" (product name) manufactured by C. Uyemura & Co. Ltd., and "TOP NICOSIT" (product name) series manufactured by Okuno Chemical Industries Co., Ltd.

In this embodiment, the pH value of the plating bath is adjusted in a range from 5 to 5.5. This is because the concentration of phosphorus $x_1$ (%) in the protective layer formed on the surface of the grid electrode 56 has to be adjusted to fall within the following range: $8 \leqq x_1 \leqq 15$. That is, if the pH value of the plating bath is unduly high, the concentration of phosphorus $x_1$ (%) in the protective layer will become low, and, if the pH value of the plating bath is unduly low, nickel contained in the plating bath will be caused to ionize, which makes protective-layer formation difficult. In this way, by adjusting the pH value of the plating bath in such a manner that the concentration of phosphorus "$x_1$", phosphorus being a substance that is less prone to be combined with oxygen, in the protective layer is larger than or equal to 8%, it is possible to prevent the surface of the grid electrode 56 from suffering from oxidation and ensuing corrosion. Moreover, by adjusting the pH value of the plating bath in such a manner that the concentration of phosphorus $x_1$ in the protective layer is smaller than or equal to 15%, it is possible to form a protective layer on the surface of the grid electrode 56 without fail. Analysis of the concentration of phosphorus $x_1$ in the protective layer can be carried out with use of commonly-known analyzing equipment for analyzing metallic composition, for example, Energy-Dispersive X-ray Fluorescence Spectrometer (ED-XRF).

Moreover, the protective layer may be formed by means of electroplating. As a plating bath for use in the electroplating process, the one that is similar to the plating bath used in the aforestated electroless plating process can be used. The conditions to be fulfilled in the electroplating process are identical with those for typical electric nickel plating process. In a case where the protective layer is formed by the electroplating process, there is a tendency inherent to electroplating; that is, the protective layer is easy to be formed at the edge part, on one hand, and the protective layer is hard to be formed at that part of the porous platy grid electrode base in which are created the through holes, on the other hand. Therefore, there is a need to increase the layer thickness in order to make the layer thickness of the protective layer uniform. Note that, in forming the protective layer, out of the electroless plating method and the electroplating method, the choice of which method to use is determined in accordance with the feature and the cost associated with each of the plating methods.

Next, a description will be given as to the thickness of the protective layer formed on the surface of the grid electrode 56. In the invention, the thickness of the protective layer is so determined that the surface of the grid electrode 56 can be protected from corrosion caused by water content in the air and ozone, nitrogen oxide, etc. generated through discharge, and thereby deterioration in charged potential stability in the grid electrode 56 can be prevented. Note that, in an attempt to obtain the protective layer having the desired thickness, the conditions set for the plating process, such as the time taken to complete the immersion of the grid electrode base in the plating bath, duration of energization time, and current value, can be changed in an appropriate manner. The measurement of the protective layer thickness can be conducted with use of a fluorescent X-ray coating thickness gauge, for example.

In order to find out a preferred protective-layer thickness range, the following experiment was conducted.

(Experiment 1)

[Formation of Grid Electrodes]

A stainless steel (SUS304)-made grid electrode base having dimensions of 30 mm by 370 mm and a thickness of 0.1 mm was subjected to etching process thereby to form a porous platy grid electrode base. Note that, in the etching process, the grid electrode base was sprayed with a 30% solution, by weight, of ferric chloride in water at a liquid temperature of 90° C. for two hours. Following the etching process, the grid electrode base was subjected to water washing and pure water cleaning, whereupon a porous platy grid electrode base was formed.

The above-described electroless plating process was performed on the surface of the porous platy grid electrode base thus obtained. In this way, there was fabricated a grid electrode G1 having a protective layer which was 15% in phosphorus concentration $x_1$ and was 0.5 μm in one-surface thickness. Note that, in the electroless plating process, the grid electrode base was immersed in a plating bath composed of nickel-phosphorus dispersion liquid prepared under conditions of a pH value of 5 to 5.5 and a bath temperature of 90° C. Following the completion of the electroless plating process, the grid electrode was taken out of the plating bath, and was then subjected to water washing, pure water cleaning, and drying. In the same manner as the grid electrode G1 thus obtained, grid electrodes G2 through G25 were fabricated that differ from one another in phosphorus concentration $x_1$ and one-surface thickness of a protective layer Table 1 shows the phosphorus concentration $x_1$ in the protective layer and the one-surface thickness of the protective layer related to each of the fabricated grid electrodes G1 through G25.

[Grid-Electrode Discharge Test]

With use of the fabricated grid electrodes G1 through G25 as grid electrodes for a charging apparatus of a commercially-available image forming apparatus (product name: MX2700 manufactured by SHARP CORPORATION), the following tests were conducted. As a severe condition test, an aging test was carried out under a high-humidity circumstance (at humidity of 80% or above). In this test, the charged potential on the surface of the photoreceptor was initially set at −600 V. Following discharge, the surface of each grid electrode was visually observed. The extent of green rust that appears on the grid electrode surface was assessed according to the following criteria:

Good: the ratio of green rust-infected area to the entire area of grid electrode surface is less than 10%;

Good/Mediocre: the ratio of green rust-infected area to the entire area of grid electrode surface is 10% or more, but less than 20%;

Mediocre: green rust appears heavily around midportion of grid electrode surface, and the ratio of green rust-infected area to the entire area of grid electrode surface is 20% or more, but less than 40%; and Failure: green rust appears over grid electrode surface, and the ratio of green rust-infected area to the entire area of grid electrode surface is 40% or more.

Moreover, a rise in potential was measured by monitoring the value of potential elevation after discharge time with respect to an initial charged potential. A case where the potential elevation value is less than 20 V is rated as "Good", a case where the potential elevation value is 20 V or more but less than 60 V is rated as "Mediocre", and a case where the potential elevation value is 60 V or more is rated as "Failure".

The result of the grid-electrode discharge test is shown in Table 1.

TABLE 1

| Grid electrode | | Protective layer | | | | | |
|---|---|---|---|---|---|---|---|
| | | Phosphorus | Thickness | | | | |
| Symbol | Thickness ($Z_1$) (mm) | concentration ($x_1$) (%) | Thickness ($Z_2$) (μm) | proportion $y_1 = (Z_2/Z_1) \times 100$ (%) | Green rust assessment | Potential elevation (V) | Potential elevation assessment |
| G1 | 0.1 | 15 | 0.5 | 0.5 | Mediocre | 20 | Mediocre |
| G2 | 0.1 | 15 | 1 | 1 | Good/Mediocre | 18 | Good |
| G3 | 0.1 | 15 | 12 | 12 | Good | 10 | Good |
| G4 | 0.1 | 15 | 16 | 16 | Good | 5 | Good |
| G5 | 0.1 | 15 | 27 | 27 | Good | 86 | Failure |
| G6 | 0.1 | 12 | 1 | 1 | Failure | 45 | Mediocre |
| G7 | 0.1 | 12 | 2 | 2 | Mediocre | 32 | Mediocre |
| G8 | 0.1 | 12 | 14 | 14 | Good | 12 | Good |
| G9 | 0.1 | 12 | 18 | 18 | Good | 7 | Good |
| G10 | 0.1 | 12 | 31 | 31 | Good | 90 | Failure |
| G11 | 0.1 | 10 | 2 | 2 | Failure | 63 | Failure |
| G12 | 0.1 | 10 | 3 | 3 | Mediocre | 42 | Mediocre |
| G13 | 0.1 | 10 | 15 | 15 | Good/Mediocre | 18 | Good |
| G14 | 0.1 | 10 | 20 | 20 | Good/Mediocre | 13 | Good |
| G15 | 0.1 | 10 | 32 | 32 | Good | 97 | Failure |
| G16 | 0.1 | 8 | 3 | 3 | Failure | 71 | Failure |
| G17 | 0.1 | 8 | 5 | 5 | Mediocre | 49 | Mediocre |
| G18 | 0.1 | 8 | 16 | 16 | Good/Mediocre | 28 | Mediocre |
| G19 | 0.1 | 8 | 21 | 21 | Good | 19 | Good |
| G20 | 0.1 | 8 | 35 | 35 | Good | 108 | Failure |
| G21 | 0.1 | 3 | 5 | 5 | Failure | 84 | Failure |
| G22 | 0.1 | 3 | 9 | 9 | Mediocre | 51 | Mediocre |
| G23 | 0.1 | 3 | 18 | 18 | Mediocre | 34 | Mediocre |
| G24 | 0.1 | 3 | 25 | 25 | Good | 26 | Mediocre |
| G25 | 0.1 | 3 | 38 | 38 | Good | 123 | Failure |

Figure 2A:
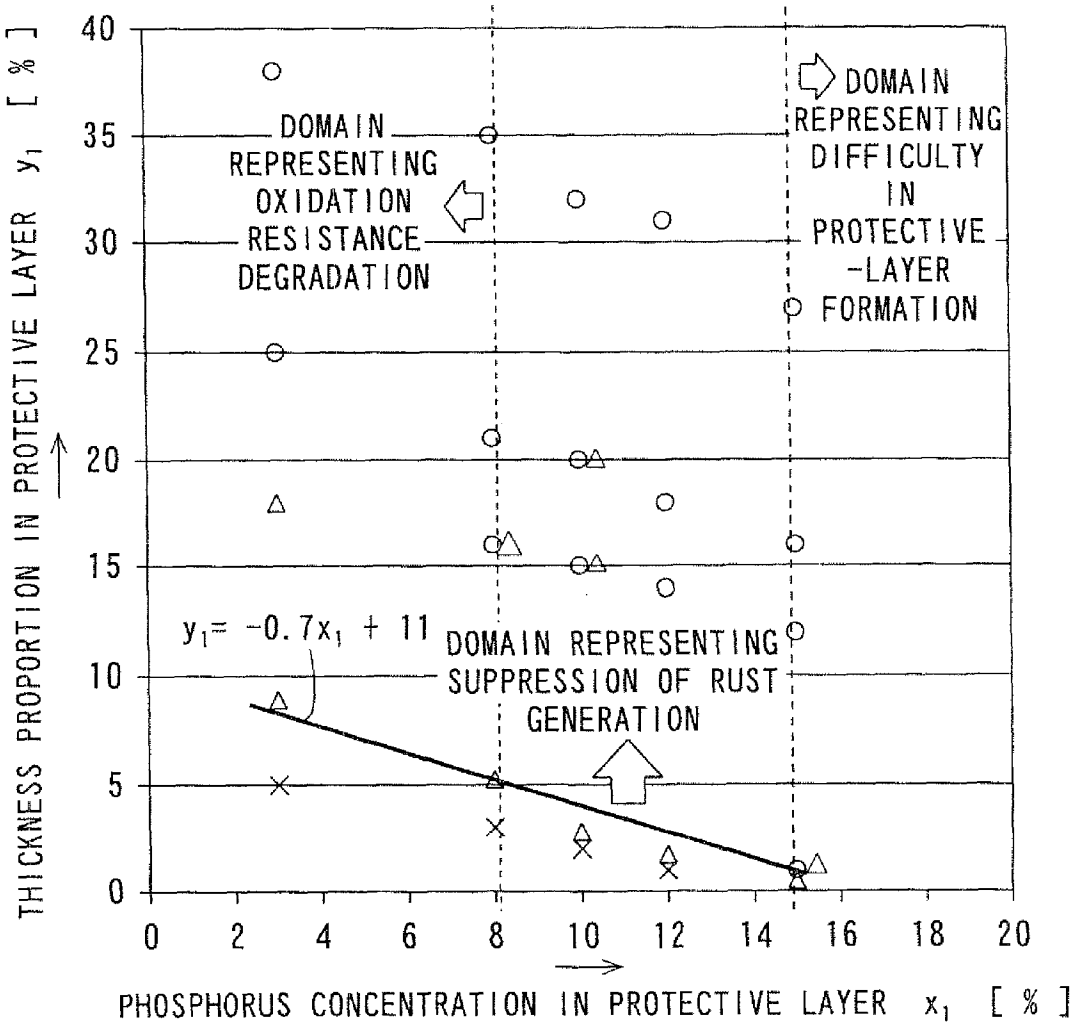
FIGS. 2A and 2B are charts showing preferred ranges of $y_1$ representing a proportion of a thickness of a protective layer to a thickness of a grid electrode and $x_1$ representing the phosphorus concentration in the protective layer.
Figure 2B:
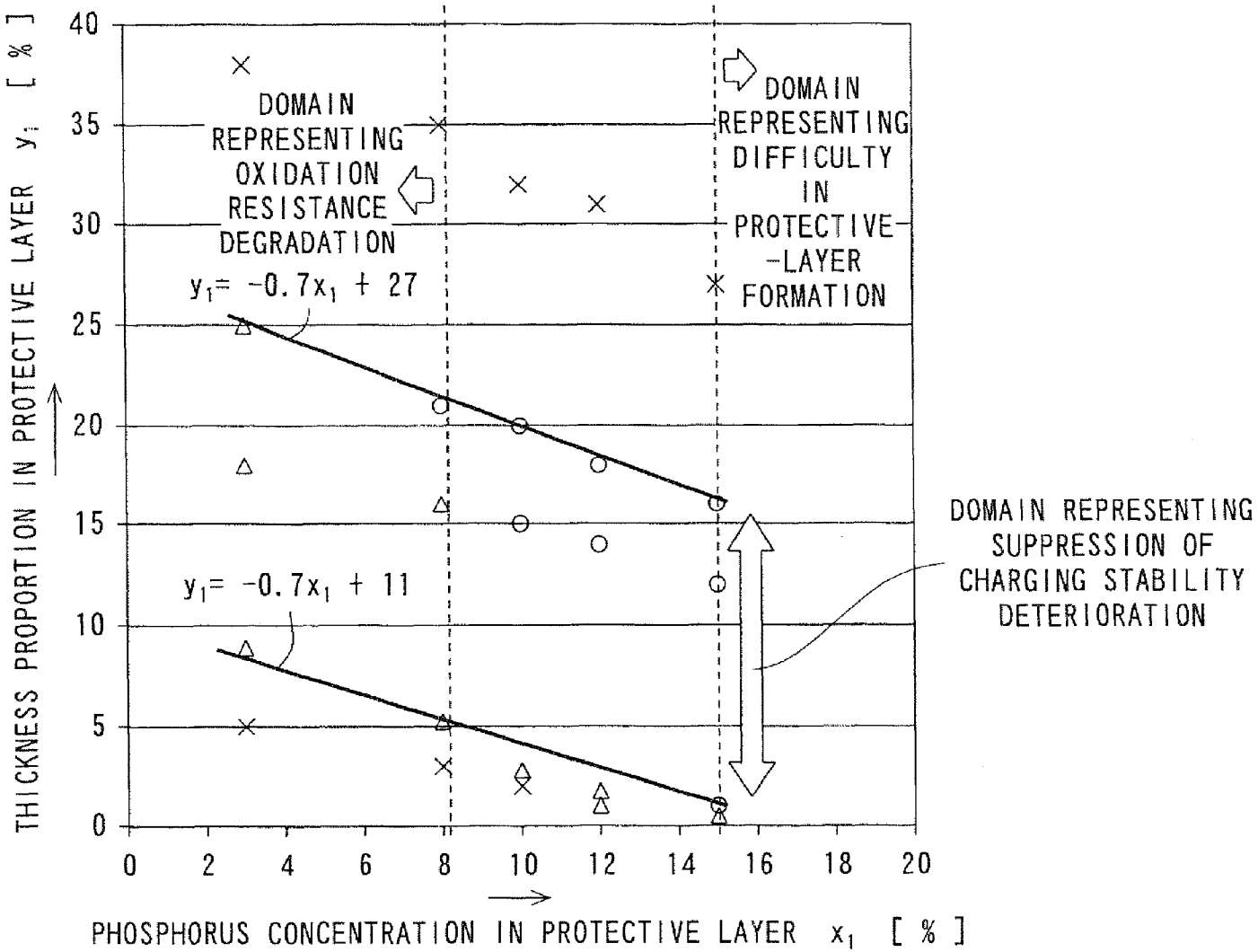

Moreover, FIGS. 2A and 2B are charts showing preferred ranges of $y_1$ representing a proportion of a thickness of the protective layer to a thickness of the grid electrode and $x_1$ representing the phosphorus concentration in the protective layer.

In FIGS. 2A and 2B, the abscissa axis represents the phosphorus concentration $x_1$ in the protective layer (%) and the ordinate axis represents the proportion in thickness of the protective layer $y_1$ (%). The proportion in thickness of the protective layer $y_1$ means the proportion of the one-surface thickness of the protective layer $Z_2$ to the thickness of the grid electrode $Z_1$, and this is calculated from the expression: $(Z_2/Z_1)\times 100$. Note that, in FIG. 2A, with respect to the phosphorus concentration $x_1$ and the thickness proportion $y_1$ of the protective layer formed on each of the fabricated grid electrodes G1 through G25, the result of green rust assessment shown in Table 1 is plotted. The mathematical expression described in FIG. 2A was derived by calculation on the basis of the plot in accordance with a least-square method. Moreover, in FIG. 2B, with respect to the phosphorus concentration $x_1$ and the thickness proportion $y_1$ of the protective layer formed on each of the fabricated grid electrodes G1 through G25, the result of potential elevation assessment shown in Table 1 is plotted. The mathematical expressions described in FIG. 2B were derived by calculation on the basis of the plot in accordance with the least-square method.

It will be apparent from Table 1 and FIG. 2A that, in the grid electrode 56 formed with a protective layer which satisfies the condition of $(-0.7x_1+11)\leqq y_1$, occurrence of green rust is suppressed successfully. This is because the protective layer formed on the surface of the grid electrode 56 serves to protect the surface of the grid electrode 56 against corrosion caused by water content in the air, and ozone and nitrogen oxide and the like generated through discharge. Moreover, it will be apparent from Table 1 and FIG. 2B that, in the grid electrode 56 formed with a protective layer which satisfies the condition of $(-0.7x_1+11)\leqq y_1\leqq(-0.7x_1+27)$, the degree of potential elevation is so small that deterioration in charged potential stability is suppressed successfully. This is because, in the case of forming a protective layer which satisfies the condition of $(-0.7x_1+11)\leqq y_1$, as has already been described, occurrence of corrosion can be prevented, and, in the case of forming a protective layer which satisfies the condition of $y_1\leqq(-0.7x_1+27)$, it is possible to prevent the through holes of the porous platy grid electrode 56 from being blocked and thereby suppress a decline in porosity. Further, by forming a protective layer so as to satisfy the condition of $y_1\leqq(-0.7x_1+27)$, the resultant protective layer can be prevented from having an unduly large thickness. As a result, it never occurs that an internal stress developed within the protective layer leads to peeling-off of the protective layer. In addition, by preventing the thickness of the protective layer from becoming too large, it is possible to limit the amount of nickel which contributes markedly to environmental pollution, as well as to prevent deterioration in environmental resistance. In light of the foregoing, in the invention, the thickness proportion $y_1$ of the protective layer formed on the surface of the grid electrode 56 is so determined that the following formula (4) formulated on the basis of the phosphorus concentration $x_1$ in the protective layer holds.

$$(-0.7x_1+11)\leqq y_1\leqq(-0.7x_1+27) \quad (4)$$

Moreover, as described earlier, the phosphorus concentration $x_1$ in the protective layer is so determined as to satisfy the condition of $8\leqq x_1\leqq 15$ from the standpoints of prevention of oxidation resistance degradation and easiness in protective layer formation.

Further, the protective layer may contain fluorinated organic fine particles. As a method for forming a protective layer containing fluorinated organic fine particles, the electroless plating method such as a catalytic nickel plating method as described above can be adopted. In electroless plating process, the grid electrode base is immersed in a plating bath, the pH value of which is adjusted in a range from 5 to 5.5, and the bath temperature of which is set at or above 90° C. Through this electroless plating process, it is possible to form a protective layer containing fluorinated organic fine particles on the surface of the grid electrode 56. As the plating bath for use in the electroless plating process, the one prepared by adding fluorinated organic fine particles to the aforementioned aqueous solution containing a hypophosphorus acid or a salt thereof and a nickel salt is used. While the additive amount of the fluorinated organic fine particles in the plating bath is not particularly restricted, it should preferably be 0.01 to 10% by weight, and more preferably 0.1 to 1.0% by weight, relative to the total weight of the plating bath. At this time, the content of the fluorinated organic fine particles in the protective layer should preferably be 3% to 30% by volume, and more preferably 20% to 30% by volume. As the fluorinated organic fine particles, there are fine particles of polytetrafluoroethylene (PTFE), fine particles of perfluoroethylene-propene copolymer (FEP) and the like. While there is no particular limitation to the particle diameter of the fluorinated organic fine particles so long as it is smaller than the thickness of the protective layer, it should preferably be 1 μm or below, and more preferably 100 to 500 nm.

In the grid electrode 56 having the fluorinated organic fine particle-containing protective layer thus far described, even if toner, for example, adheres to the surface of the grid electrode 56, the adherence thereof can be diminished. Accordingly, it is possible to remove adherents easily by a subsequently-described cleaning member.

Moreover, the grid electrode 56 may be so designed that a pre-treatment layer made of a conductive material is interposed between the grid electrode base and the protective layer. This pre-treatment layer may be formed by means of plating before the protective layer is formed on the surface of the grid electrode 56. The process of plating can be carried out in accordance with a commonly-performed method. As the conductive material, for example, there are nickel, aluminum, copper, and iron. While the layer thickness of the pre-treatment layer is not particularly restricted, it should preferably be 0.03 to 3 μm, and more preferably 0.5 to 1.5 μm, and especially preferably ca. 1 μm.

As described hereinabove, since the pre-treatment layer is formed by means of plating, it is possible to remove a residual fluid such as stain and oil adherent to the grid electrode base formed through the etching process, and thereby protect the surface of the grid electrode base against residual fluid-induced corrosion. Moreover, by using the pre-treatment layer as a conductive material, it is possible to enhance the adherability between the pre-treatment layer and the protective layer made of nickel and phosphorus, and thereby prevent the protective layer from peeling off at the interface between the pre-treatment layer and the protective layer. Further, by selecting a conductive material having adequate electrical conductivity, it is possible to achieve easy adjustment of the charged potential on the surface of the photoreceptor.

Moreover, the grid electrode 56 may be so designed that an after-treatment layer made of a conductive material is formed on the protective layer. This after-treatment layer may be formed by means of plating after the protective layer is formed on the surface of the grid electrode 56. While the process of plating can be carried out in accordance with a commonly-performed method, in this case, it is desirable to perform electrolytic plating under application of DC current and AC current. As the conductive material, for example, there are gold and platinum. While the layer thickness of the after-treatment layer is not particularly restricted, it should preferably be 0.3 μm or above.

As described hereinabove, since the after-treatment layer is formed on the protective layer, even if pinholes are developed in the protective layer, the pinholes can be covered with the after-treatment layer. This helps prevent water content in the air, and ozone and nitrogen oxide and the like generated through discharge from finding their ways to the surface of the grid electrode base through the pinholes. Moreover, by using the after-treatment layer as a conductive material, it is possible to enhance the adherability between the after-treatment layer and the protective layer made of nickel and phosphorus, and thereby prevent the after-treatment layer from peeling off at the interface between the after-treatment layer and the protective layer. Further, by selecting a conductive material having adequate electrical conductivity, it is possible to achieve easy adjustment of the charged potential on the surface of the photoreceptor.

In the second embodiment of the invention, the needle-like electrode 50 has, on at least its one surface, a protective layer made of nickel and phosphorus for surface protection. As a method for forming a protective layer on the surface of the needle-like electrode 50, the one similar to the above-described method for forming a protective layer on the surface of the grid electrode 56 can be adopted, and therefore the detailed description thereof will be omitted. At this time, the concentration of phosphorus $x_2$ (%) in the protective layer formed on the surface of the needle-like electrode 50 is so determined as to satisfy the condition of $8 \leqq x_2 \leqq 15$ from the standpoints of prevention of oxidation resistance degradation and easiness in protective layer formation.

Next, a description will be given as to the thickness of the protective layer formed on the surface of the needle-like electrode 50. In the invention, the thickness of the protective layer is so determined that the surface of the needle-like electrode 50 can be protected from corrosion caused by water content in the air, and ozone and nitrogen oxide and the like generated through discharge, and thereby deterioration in charged potential stability in the needle-like electrode 50 can be prevented. Note that, in an attempt to obtain the protective layer having the desired thickness, the conditions set for the plating process, such as the time taken to complete immersion of a needle-like electrode base in a plating bath, duration of energization time, and current value, can be changed in an appropriate manner.

In order to find out a preferred protective-layer thickness range, the following experiment was conducted.

(Experiment 2)

[Formation of Needle-Like Electrode]

A stainless steel (SUS304)-made needle-like electrode base having dimensions of 20 mm by 310 mm and a thickness of 0.1 mm was subjected to masking process and etching process thereby to form a needle-like electrode base. Note that, in the etching process, the needle-like electrode base was sprayed with a 30% solution, by weight, of ferric chloride in water at a liquid temperature of 90° C. for two hours. Following the etching process, the needle-like electrode base was subjected to water washing and pure water cleaning, whereupon a needle-like electrode base was formed.

Electroless plating process was performed on the surface of the needle-like electrode base thus obtained. In this way, there was fabricated a needle-like electrode H1 having a protective layer which was 15% in phosphorus concentration $x_2$ and was 0.5 μm in one-surface thickness. Following the completion of the electroless plating process, the needle-like electrode was taken out of a plating bath, and was then subjected to water washing, pure water cleaning, and drying. In the same manner as the needle-like electrode H1 thus obtained, needle-like electrodes H2 through H25 were fabricated that differ from one another in phosphorus concentration $x_2$ and one-surface thickness of a protective layer. Table 2 shows the phosphorus concentration $x_2$ in the protective layer and the one-surface thickness of the protective layer related to each of the needle-like electrodes H1 through H25.

With use of the needle-like electrodes H1 through H25 as discharging electrodes for a charging apparatus of a commercially-available image forming apparatus (product name: MX2700 manufactured by SHARP CORPORATION), tests similar to the above-described anti-corrosion tests performed on the grid electrodes G1 through G25 were conducted. The result of the discharge test performed on each of the needle-like electrodes H1 through H25 is shown in Table 2.

TABLE 2

| Needle-like | | Protective layer | | | | | |
|---|---|---|---|---|---|---|---|
| | | Phosphorus | Thickness | | | | |
| Symbol | Thickness ($Z_3$) (mm) | concentration ($x_2$) (%) | Thickness ($Z_4$) (μm) | proportion $y_2 = (Z_4/Z_3) \times 100$ (%) | Green rust assessment | Potential elevation (V) | Potential elevation assessment |
| H1 | 0.1 | 15 | 0.5 | 0.5 | Mediocre | 20 | Mediocre |
| H2 | 0.1 | 15 | 1 | 1 | Good/Mediocre | 19 | Good |
| H3 | 0.1 | 15 | 12 | 12 | Good | 14 | Good |
| H4 | 0.1 | 15 | 16 | 16 | Good | 9 | Good |
| H5 | 0.1 | 15 | 27 | 27 | Good | 90 | Failure |
| H6 | 0.1 | 12 | 1 | 1 | Failure | 48 | Mediocre |
| H7 | 0.1 | 12 | 2 | 2 | Mediocre | 34 | Mediocre |
| H8 | 0.1 | 12 | 14 | 14 | Good | 15 | Good |
| H9 | 0.1 | 12 | 18 | 18 | Good | 10 | Good |
| H10 | 0.1 | 12 | 31 | 31 | Good | 95 | Failure |
| H11 | 0.1 | 10 | 2 | 2 | Failure | 66 | Failure |
| H12 | 0.1 | 10 | 3 | 3 | Mediocre | 44 | Mediocre |
| H13 | 0.1 | 10 | 15 | 15 | Good/Mediocre | 19 | Good |
| H14 | 0.1 | 10 | 20 | 20 | Good/Mediocre | 17 | Good |
| H15 | 0.1 | 10 | 32 | 32 | Good | 101 | Failure |
| H16 | 0.1 | 8 | 3 | 3 | Failure | 74 | Failure |
| H17 | 0.1 | 8 | 5 | 5 | Mediocre | 52 | Mediocre |
| H18 | 0.1 | 8 | 16 | 16 | Good/Mediocre | 31 | Mediocre |
| H19 | 0.1 | 8 | 21 | 21 | Good | 19 | Good |
| H20 | 0.1 | 8 | 35 | 35 | Good | 110 | Failure |
| H21 | 0.1 | 3 | 5 | 5 | Failure | 85 | Failure |
| H22 | 0.1 | 3 | 9 | 9 | Mediocre | 53 | Mediocre |
| H23 | 0.1 | 3 | 18 | 18 | Mediocre | 37 | Mediocre |
| H24 | 0.1 | 3 | 25 | 25 | Good | 28 | Mediocre |
| H25 | 0.1 | 3 | 38 | 38 | Good | 127 | Failure |

Moreover, on the graph in which the abscissa axis represents the phosphorus concentration $x_2$ in the protective layer (%) and the ordinate axis represents the proportion in thickness of the protective layer $y_2$ (%), just as was the case with the grid electrodes G1 through G25 described previously, the result of green rust assessment and the result of potential elevation assessment shown in Table 2 were plotted thereby to obtain a preferred range of the proportion in thickness of the protective layer $y_2$ relative to the needle-like electrode. The proportion in thickness of the protective layer $y_2$ means the proportion of the one-surface thickness of the protective layer $Z_4$ to the thickness of the needle-like electrode $Z_3$, and this is calculated from the expression: $(Z_4/Z_3)\times 100$. In the invention, the thickness proportion $y_2$ of the protective layer formed on the surface of the needle-like electrode 50 is so determined that the following formula (5) formulated on the basis of the phosphorus concentration $x_2$ in the protective layer holds.

$$(-0.7x_2+11) \leqq y_2 \leqq (-0.7x_2+27) \quad (5)$$

In the second embodiment of the invention, on the surface of the needle-like electrode 50 is formed a protective layer which satisfies the condition of $(-0.7x_2+11) \leqq y_2$. Accordingly, the surface of the needle-like electrode 50 can be protected from corrosion caused by water content in the air and ozone, nitrogen oxide and the like generated through discharge, as well as from occurrence of pinholes. Moreover, on the surface of the needle-like electrode 50 is formed a protective layer which satisfies the condition of $(-0.7x_2+11) \leqq y_2 \leqq (-0.7x_2+27)$. Accordingly, a decline in charged potential stability in the needle-like electrode 50 can be suppressed.

Moreover, the protective layer formed on the needle-like electrode 50 may contain fluorinated organic fine particles, just like the above-described grid electrode 56. Further, in the needle-like electrode 50 having the protective layer, just like the above-described grid electrode 56, a pre-treatment layer may be interposed between the needle-like electrode base and the protective layer, and also an after-treatment layer may be formed on the protective layer.

The needle-like electrode 50 is, for example, a stainless steel-made thin plate member composed of a flat plate portion 57 extending longwise in one direction and pointed protrusions 58 that are each so formed as to protrude from one end face of the flat plate portion 57 in the transverse direction thereof. In regard to the dimension of the needle-like electrode 50, illustratively, a length L1 of the flat plate portion 57 in its transverse direction is preferably set at approximately 10 mm, a length L2 of the protrusion 58 in its protruding direction is preferably set at approximately 2 mm, a radius of curvature R at the front end of the protrusion 58 is preferably set at approximately 40 μm, and a pitch TP at which are arranged the protrusions 58 is preferably set at approximately 2 mm.

For example, the needle-like electrode 50 can be processed into such a configuration with the pointed protrusions 58 by means of etching, precision press working, or otherwise. In the needle-like electrode 50 base formed through etching process, its etching-processed cross section incurs minute irregularities from lack of smoothness. Furthermore, the front end of the pointed protrusion for effecting discharge has also an etching-processed cross section lacking in smoothness. This leads to non-uniform discharge. In addition, since the minute irregularities on the etching-processed cross section are susceptible to adhesion of toner and so forth, it follows that the discharge non-uniformity may be exacerbated. Even if the surface of the needle-like electrode base is covered through typical plating process, such minute irregularities on the etching-processed cross section remain intact.

In this regard, the protective layer according to the invention, the thickness proportion of which fulfills the aforestated formula (5), is easily laminated even on the minute irregularity-bearing etching-processed cross section. Accordingly, in the needle-like electrode 50 of the invention that is constructed by forming the protective layer on the surface of the needle-like electrode base, an etching-processed cross section can be made smooth. This helps prevent occurrence of non-uniform discharge and adhesion of toner and so forth.

In the third embodiment of the invention, the grid electrode 56 has a protective layer made of nickel and phosphorus for surface protection formed at least on its one surface, and so does the needle-like electrode 50. The protective layer of the grid electrode 56 in the third embodiment can be provided in the same manner as in the preceding first embodiment. Similarly, the protective layer of the needle-like electrode 50 in the third embodiment can be provided in the same manner as in the preceding second embodiment.

In the third embodiment, like the preceding first and second embodiments, the protective layer formed on the surface of the grid electrode 56, as well as on the surface of the needle-like electrode 50, is so designed that the concentration of phosphorus $x_3$ (%) in the protective layer satisfies the condition of $8 \leqq x_3 \leqq 15$, and that the proportion in thickness of the protective layer $y_3$ fulfills the following formula (6) formulated on the basis of the phosphorus concentration $x_3$ in the protective layer. The proportion in thickness of the protective layer $y_3$ means the proportion of the one-surface thickness of the protective layer $Z_6$ to the thickness $Z_5$ of the grid electrode 56, as well as the needle-like electrode 50, and this is calculated from the expression: $(Z_6/Z_5)\times 100$.

$$(-0.7x_3+11) \leqq y_3 \leqq (-0.7x_3+27) \quad (6)$$

In the third embodiment of the invention, on the surface of the grid electrode 56, as well as on the surface of the needle-like electrode 50, is formed a protective layer which satisfies the condition of $(-0.7x_3+11) \leqq y_3$. Accordingly, the surfaces of the grid electrode 56 and the needle-like electrode 50 can be protected from corrosion caused by water content in the air, and ozone and nitrogen oxide and the like generated through discharge, as well as from occurrence of pinholes. Moreover, on the surface of the grid electrode 56, as well as on the surface of the needle-like electrode 50, is formed a protective layer which satisfies the condition of $(-0.7x_3+11) \leqq y_3 \leqq (-0.7x_3+27)$. Accordingly, a decline in charged potential stability in the grid electrode 56 and the needle-like electrode 50 can be suppressed.

While the first, second, and third embodiments are each illustrated as employing the needle-like electrode having pointed protrusions as a discharging electrode, the invention is not limited thereto. For example, a charging wire can be used instead. As the charging wire, any of those used customarily in the relevant field can be used. For example, there is a charging wire constructed by plating a tungsten wire which is 0.06 mm in wire diameter with gold. In the case of using a columnar charging wire as a discharging electrode, the proportion in thickness of a protective layer formed on the charging wire means the proportion of the thickness of the protective layer to the gauge of the charging wire (cross-sectional diameter). In this case, the protective layer is so formed as to fulfill the aforestated formula (5).

As shown in FIG. 1, the holding member 51 for holding the needle-like electrode 50 is a member which extends, like the needle-like electrode 50, longwise in one direction, has an inverted T-shaped sectional profile in a direction perpendicular to a longitudinal direction thereof, and is made for example of resin. The needle-like electrode 50 is screwed, in the vicinity of the opposite ends thereof in the longitudinal direction, to one side surface of a projected part of the holding member 51 by a thread member 59. The needle-like electrode 50 receives application of a voltage of about 5 kV to effect corona discharge during operation for charging the photoreceptor drum 11 as will hereafter be described. The voltage is applied to the needle-like electrode 50 from a non-illustrated power source. Upon voltage application, corona discharge takes place from the pointed protrusions 58 toward the surface of the photoreceptor drum 11, whereupon the surface of the photoreceptor drum 11 is electrically charged.

As a metal material for constituting the cleaning members 52*a* and 52*b*, phosphor bronze, common steel, stainless steel, and the like can be used. Among them, in consideration of the fact that the cleaning members 52*a* and 52*b* are used in an atmosphere of ozone generated by corona discharge, stainless steel is desirable in view of durability lifetime related to oxidation resistance. As the stainless steel, any of those heretofore known can be used. For example, there are SUS304 which is austenitic stainless steel and SUS430 which is ferritic stainless steel that are defined as G4305 according to Japanese Industrial Standard (JIS).

It is preferable that the cleaning members 52*a* and 52*b* have a hardness of 115 or above on Rockwell hardness M scale according to American Society for Testing and Materials (ASTM) Standard D785. If the Rockwell hardness is less than 115, the material softness is so high that the cleaning members 52*a* and 52*b* become deformed needlessly when they graze the needle-like electrode 50 in abutment therewith. This makes it impossible to obtain an adequate cleaning effect. Meanwhile, since there arises no particular problem in terms of function even though the cleaning members 52*a* and 52*b* have a high hardness, it is not necessary to define the upper limit of the hardness. However, considering that the upper limit value in the Rockwell hardness M scale is 130, setting the upper value at 130 will be considered reasonable.

The support member 53 is a member having an inverted L-shaped configuration for supporting the cleaning members 52*a* and 52*b*. In its beam-like portion, the T-shaped arm portions of the cleaning members 52*a* and 52*b* are attached. The two cleaning members 52*a* and 52*b* are disposed, with a predetermined interval L2 secured therebetween with respect to a direction in which they are moved relatively to the needle-like electrode 50. The interval L2 is selected to be a distance such that, when one of the cleaning members 52*a* is deformed in abutment with the needle-like electrode 50, the other cleaning member 52*b* is kept out of contact with the cleaning member 52*a* in a deformed state. The distance can be controlled by adjusting the thickness of the beam-like portion of the support member 53 to which are attached the cleaning members. Since the state of deformation varies depending on the material for constituting the cleaning members 52*a* and 52*b*, it is preferable that the interval L2 is determined after testing the state of deformation of the material. In a case where the cleaning member 52*a*, 52*b* is made for example of stainless steel having a thickness of t=30 μm, then the interval L2 is preferably set at 2 mm. With the provision of the interval L2 between the two cleaning members 52*a* and 52*b*, during the time when one cleaning member 52*a* is grazing the needle-like electrode 50, a pressing force in an adequate range can be maintained without causing hindrance to its deformation by the other cleaning member 52*b*. This makes it possible to clean the needle-like electrode 50 sufficiently without causing deformation damage to its front end.

The shield case 55 is a container-like member with an inner space made for example of stainless steel having a rectangular parallelepiped outer shape. An opening is formed on one surface of the shield case 55 that faces the subsequently-described photoreceptor drum 11. Moreover, the shield case 55 extends longwise in the same direction as that in which the needle-like electrode 50 extends, and has a substantially U-shaped sectional profile in a direction perpendicular to a longitudinal direction thereof. The holding member 51 is attached to a bottom surface 63 of the shield case 55. Moreover, an inner side surface 61 of the shield case 55 and the holding member 51 constitute a groove 62 in which is slidably inserted the end of a columnar portion of the support member 53.

The support member 53 has, in its columnar portion, a through hole 60 created in parallel with the direction in which the needle-like electrode 50 extends. The moving member 54 is so disposed as to be inserted into the through hole 60. Since the moving member 54 is fixed to the support member 53 at the part inserted through the through hole 60, as the moving member 54 is pulled in the direction in which the needle-like electrode 50 extends, the support member 53 is slidable with respect to the groove 62, so that it is movable in the direction in which the needle-like electrode 50 extends by being guided by the groove 62. That is, the cleaning members 52*a* and 52*b* supported by the support member 53 are allowed to abut against and graze the needle-like electrode 50.

At the time of cleaning the needle-like electrode 50 by keeping the cleaning members 52*a* and 52*b* in abutment therewith under the traction of the moving member 54, the pressing force of the cleaning members 52*a* and 52*b* exerted on the needle-like electrode 50 should preferably be adjusted in a range from 10 to 30 gf. If the pressing force is less than 10 gf, there is a possibility that contaminants such as toner and paper dust deposited to the needle-like electrode 50 cannot be removed satisfactorily. On the other hand, if the pressing force exceeds 30 gf, there is a possibility that the front end of the protrusion 58 of the needle-like electrode 50 suffers from deformation damage.

For example, the pressing force of the cleaning members 52*a* and 52*b* exerted on the needle-like electrode 50 can be adjusted as follows. In a state where a weight is suspended from one end of the moving member 54, a force loaded on the cleaning member 52*a* or 52*b* is measured. The measurement is conducted for example by connecting a spring balance to the cleaning member 52*a* or 52*b*. Then, selection of a weight is made in such a manner that a force of 10 to 30 gf is loaded on the cleaning member 52*a* or 52*b*. In cleaning the needle-like electrode 50, a pre-selected weight is suspended from the end of the moving member 54. In this way, cleaning can be carried out under a predetermined pressing force. Alternatively, a rotary torque-adjusted electric motor may be connected to the end of the moving member 54 so as for a predetermined pressing force to be loaded.

Figure 3:
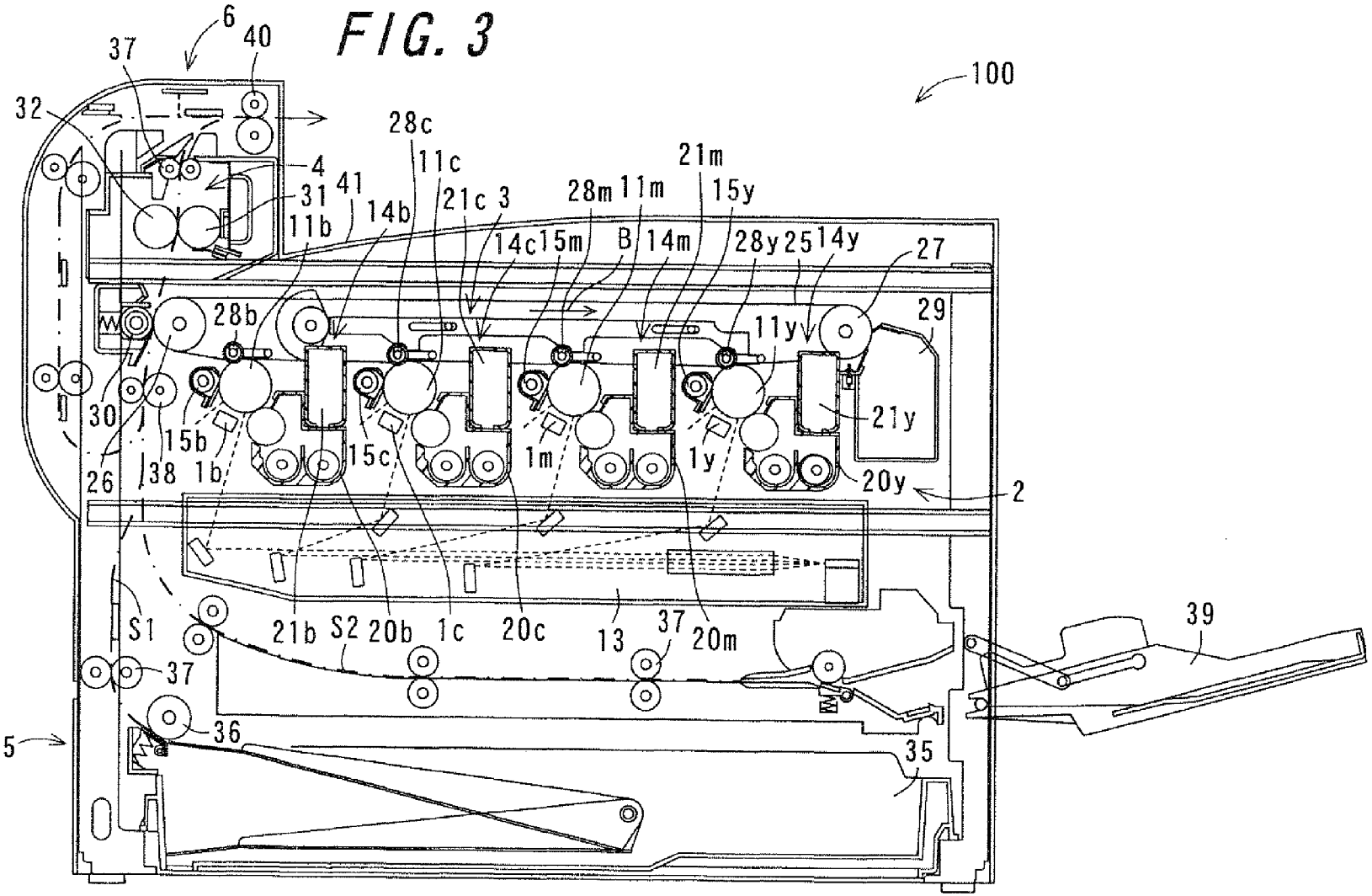
FIG. 3 is a sectional view showing the structure of an image forming apparatus in accordance with one embodiment of the invention.

FIG. 3 is a sectional view showing the structure of an image forming apparatus 100 in accordance with one embodiment of the invention. The image forming apparatus 100 is provided with the above-described charging apparatus 1 capable of keeping the charged potential on the surface of the photoreceptor in an adequate range for a longer period of time. Accordingly, the image forming apparatus 100 succeeds in recording high-quality images for a longer period of time. The image forming apparatus 100, which is built as a multi-function machine having a copier function, a printer function, and a facsimile function, acts to form a full-color or monochromatic image on a recording medium in response to image information transmitted. That is, the image forming apparatus 100 has three printing modes: a copier mode (duplicator mode), a printer mode, and a FAX mode. In this construction, for example, in response to a manipulated input provided via a non-illustrated operating section and receipt of a print job from a personal computer, a portable terminal unit, an information recording/storage medium, and external equipment using a memory device, a printing mode selection is made by a non-illustrated control unit. The image forming apparatus 100 includes a toner image forming section 2, a transferring section 3, a fixing section 4, a recording medium feeding section 5, and a discharging section 6. In order to deal with image information on four colors: black (b); cyan (c); magenta (m); and yellow (y) included in color image information on an individual basis, the members constituting the toner image forming section 7 and part of the members included in the transferring section 3 are each correspondingly four in number. The four pieces of the constituent members provided for different colors are distinguishable according to the alphabetical suffixes indicating their respective colors added to the reference symbols, and collectively, they are represented only by the reference symbols.

The toner image forming section 2 includes the photoreceptor drum 11, a charging apparatus 1, an exposure unit 13, a developing section 14, and a cleaning unit 15. The charging apparatus 1, the developing section 14, and the cleaning unit 15 are arranged in the order named along a direction in which the photoreceptor drum 11 is rotated. The charging apparatus 1 is arranged vertically below the developing section 14 and the cleaning unit 15.

The photoreceptor drum 11, which is so supported that it can be driven to rotate about its axis by a non-illustrated driving portion, is composed of a conductive base body and a photosensitive layer formed on the surface of the conductive base body that are not shown in the figure. The conductive base body may be formed in various shapes, for example, a cylindrical shape, a circular columnar shape, and a lamellar sheet shape. Among them, a cylindrical shape is preferable. The conductive base body is constructed of a conductive material. As the conductive material, any of those used customarily in the relevant field can be used. The examples thereof include: a metal such as aluminum, copper, brass, zinc, nickel, stainless steel, chrome, molybdenum, vanadium, indium, titanium, gold, and platinum; an alloy of two or more kinds of these metals; a conductive film obtained by forming, on a film-shaped base such as a synthetic resin film, a metal film, or paper, a conductive layer made of one or two or more of substances selected from among aluminum, an aluminum alloy, tin oxide, gold, indium oxide, and so forth; and a resin composition product containing at least one of conductive particles and conductive polymer. Note that, as a film-shaped base used for the conductive film, a synthetic resin film is preferable, and a polyester film is particularly preferable. Moreover, it is preferable that the conductive layer of the conductive film is formed by means of vapor deposition, coating, or otherwise.

For example, the photosensitive layer is formed by stacking a charge generating layer containing a charge generating substance and a charge transporting layer containing a charge transporting substance on top of each other. At this time, it is preferable to interpose an undercoat layer between the conductive base body and the charge generating layer or the charge transporting layer. With the provision of the undercoat layer, it is possible to gain several advantages that flaws and asperities existing on the surface of the conductive base body can be covered to make the surface of the photosensitive layer smooth, that deterioration in chargeability in the photosensitive layer resulting from repeated use can be prevented, and that the charging characteristic of the photosensitive layer under at least one of a low-temperature environment and a low-humidity environment can be enhanced. Alternatively, it is possible to employ a highly-durable lamination type photoreceptor of a three-layer structure having a photoreceptor surface protective layer as its uppermost layer.

The charge generating layer is composed predominantly of a charge generating substance which generates electric charges by light irradiation, and may contain known binder resin, plasticizer, and sensitizer on an as needed basis. As the charge generating substance, any of those used customarily in the relevant field can be used. The examples thereof include: a perylene-based pigment such as perylene imide and perylenic acid anhydride; a polycyclic quinone-based pigment such as quinacridone and anthraquinone; a phthalocyanine-based pigment such as metallophthalocyanine, metal-free phthalocyanine, and halogenated metal-free phthalocyanine; a squarylium dye; an azulenium dye; a thiapyrylium dye; and an azo pigment having a carbazole skeleton, a styryl stilbene skeleton, a triphenyl amine skeleton, a dibenzothiophene skeleton, an oxadiazole skeleton, a fluorenone skeleton, a bisstilbene skeleton, a distyryl oxadiazole skeleton, or a distyryl carbazole skeleton. Among them, a metal-free phthalocyanine pigment, an oxotitanyl phthalocyanine pigment, a bis azo pigment containing at least one of fluorene ring and fluorenone ring, a bis azo pigment composed of aromatic amine, and a tris azo pigment offer high charge generating capability and thus lend themselves to formation of a photosensitive layer having high sensitivity. One of those charge generating substances may be used alone or two or more of them may be used in combination. While the content of the charge generating substance is not particularly restricted, it should preferably fall in a range from 5 to 500 parts by weight, and more preferably from 10 to 200 parts by weight, with respect to 100 parts by weight of a binder resin contained in the charge generating layer. As the binder resin for use in the charge generating layer, any of those used customarily in the relevant field can be used. The examples thereof include a melamine resin, an epoxy resin, a silicone resin, polyurethane, an acrylic resin, a vinyl chloride-vinyl acetate copolymer resin, polycarbonate, a phenoxy resin, polyvinyl butyral, polyallylate, polyamide, and polyester. One of those binder resins may be used alone or two or more of them may be used in combination on an as needed basis.

The charge generating layer is formed as follows. The charge generating substance and the binder resin, and also, if necessary, a plasticizer, a sensitizer, or the like agent, are each dissolved or dispersed in an adequate amount in a suitable organic solvent capable of dissolving or dispersing such components thereby to prepare a primer liquid of the charge generating layer. This charge generating layer primer liquid is applied onto the surface of the conductive base body, followed by drying. While the film thickness of the thus obtained charge generating layer is not particularly restricted, it should preferably fall in a range from 0.05 to 5 μm, and more preferably from 0.1 to 2.5 μm.

The charge transporting layer, which is laminated on the charge generating layer, contains, as essential constituents, a charge transporting substance having the capability of receiving and transporting electric charges generated from the charge generating substance and a binder resin for use in the charge transporting layer, and may also contain known antioxidant, plasticizer, sensitizer, lubricant, and the like agent on an as needed basis. As the charge transporting substance, any of those used customarily in the relevant field can be used. The examples thereof include: an electron donative substance such as poly-N-vinyl carbazole and its derivatives, poly-γ-carbazolyl ethyl glutamate and its derivatives, a condensation product of pyrene-formaldehyde and its derivatives, polyvinylpyrene, polyvinyl phenanthrene, an oxazole derivative, an oxodiazole derivative, an imidazole derivative, 9-(p-diethyl aminostyryl) anthracene, 1,1-bis (4-dibenzylaminophenyl) propane, styryl anthracene, styryl pyrazoline, a pyrazoline derivative, phenylhydrazones, a hydrazone derivative, a triphenylamine-based compound, a tetraphenyldiamine-based compound, a triphenylmethane-based compound, a stilbene-based compound, and an azine compound having a 3-methyl-2-benzothiazoline ring; and an electron accepting substance such as a fluorenone derivative, a dibenzothiophene derivative, an indenothiophene derivative, a phenanthrenequinone derivative, an indenopyridine derivative, a thioxanthone derivative, a benzo [c] cinnoline derivative, a phenazine oxide derivative, tetracyanoethylene, tetracyanoquinodimethane, bromanil, chloranil, and benzoquinone. One of those charge transporting substances may be used alone or two or more of them may be used in combination. While the content of the charge transporting substance is not particularly restricted, it should preferably fall in a range from 10 to 300 parts by weight, and more preferably, from 30 to 150 parts by weight, with respect to 100 parts by weight of the binder resin contained in the charge transporting layer. As the binder resin used for the charge transporting layer, any of those used customarily in the relevant field and allowing uniform dispersion of the charge transporting substance can be used. The examples thereof include polycarbonate, polyallylate, polyvinyl butyral, polyamide, polyester, polyketone, an epoxy resin, polyurethane, polyvinylketone, polystyrene, polyacrylamide, a phenol resin, a phenoxy resin, a polysulfone resin, and copolymer resins thereof. Among them, in view of film formation suitability and the abrasion resistance and electrical characteristics of the charge transporting layer to be obtained, for example, polycarbonate containing bisphenol Z as a monomer component (hereafter referred to as "bisphenol Z type polycarbonate") and an admixture of bisphenol Z type polycarbonate and other polycarbonate are desirable for use. One of those binder resins may be used alone or two or more of them may be used in combination.

It is preferable that the charge transporting layer contains an antioxidant together with the charge transporting substance and the binder resin for use in the charge transporting layer. As the antioxidant, any of those used customarily in the relevant field can be used, too. The examples thereof include Vitamin E, hydroquinone, hindered amine, hindered phenol, paraphenylene diamine, arylalkane and derivatives thereof, an organic sulfur compound, and an organic phosphorus compound. One of those antioxidants may be used alone or two or more of them may be used in combination. While the content of the antioxidant is not particularly restricted, it should preferably fall in a range from 0.01 to 10% by weight, and more preferably, from 0.05 to 5% by weight, with respect to the total amount of the ingredients constituting the charge transporting layer. The charge transporting layer can be formed as follows. The charge transporting substance and the binder resin, and also, if necessary, an antioxidant, a plasticizer, a sensitizer, or the like agent, are each dissolved or dispersed in an adequate amount in a suitable organic solvent capable of dissolving or dispersing such components thereby to prepare a primer liquid of the charge transporting layer. This charge transporting layer primer liquid is applied onto the surface of the charge generating layer, followed by drying. While the film thickness of the thus obtained charge transporting layer is not particularly restricted, it should preferably fall in a range from 10 to 50 μm, and more preferably from 15 to 40 μm. Alternatively, it is possible to form a photosensitive layer consisting of a single layer containing both a charge generating substance and a charge transporting substance. In this case, various conditions such as the kind and content of the charge generating substance and the charge transporting substance, the kind of the binder resin, and other additives may be identical with those adopted in the case of forming the charge generating layer and the charge transporting layer separately.

While this embodiment employs a photoreceptor drum having formed thereon an organic photosensitive layer using the charge generating substance and the charge transporting substance as described hereinabove, it is possible to employ instead a photoreceptor drum on which is formed an inorganic photosensitive layer using silicon or the like substance.

The charging apparatus 1 is disposed face to face with the photoreceptor drum 11 and is spaced away from the surface of the photoreceptor drum 11 along the direction of length of the photoreceptor drum 11 so as to charge the surface of the photoreceptor drum 11 to a predetermined potential with predetermined polarity.

The exposure unit 13 is disposed so that light beams corresponding to each color information emitted from the exposure unit 13 pass between the charging section 12 and the developing device 14 and reach the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED (Light Emitting Diode) array and a unit in which a liquid-crystal shutter and a light source are appropriately combined with each other.

The developing section 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller, a supplying roller, and an agitating roller, or screw members, which roller or screw members are contained in the developing tank 20. The developing tank 20 has an opening in a side face thereof opposed to the photoreceptor drum 11. The developing roller is rotatably provided at such a position as to face the photoreceptor drum 11 through the opening just stated. The developing roller is a roller-shaped member for supplying a toner to the electrostatic latent image on the surface of the photoreceptor drum 11 in a pressure-contact portion or most-adjacent portion between the developing roller and the photoreceptor drum 11. In supplying the toner, to a surface of the developing roller is applied potential whose polarity is opposite to polarity of the potential of the charged toner, which serves as development bias voltage. By so doing, the toner on the surface of the developing roller is smoothly supplied to the electrostatic latent image. Furthermore, an amount of the toner being supplied to the electrostatic latent image (which amount is referred to as "toner attachment amount") can be controlled by changing a value of the development bias voltage. The supplying roller is a roller-shaped member which is rotatably disposed so as to face the developing roller and used to supply the toner to the vicinity of the developing roller. The agitating roller is a roller-shaped member which is rotatably disposed so as to face the supplying roller and used to feed to the vicinity of the supplying roller the toner which is newly supplied from the toner hopper 21 into the developing tank 20. The toner hopper 21 is disposed so as to communicate a toner replenishment port (not shown) formed in a vertically lower part of the toner hopper 21, with a toner reception port (not shown) formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transferring section 3 is disposed above the photoreceptor drum 11 and includes the intermediate transfer belt 25, a driving roller 26, a driven roller 27, intermediate transferring rollers 28(*b, c, m, y*), a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image. The driving roller 26 can rotate around an axis thereof with the aid of a driving section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contact with an outer circumferential surface of the intermediate transfer belt 25. The residual toner which is attached to the intermediate transfer belt 25, which is caused by contact of the intermediate transfer belt 25 with the photoreceptor drum 11, may cause contamination on a reverse side of the recording medium, the transfer belt cleaning unit 29 removes and collects the toner on the surface of the intermediate transfer belt 25. The transferring roller 30 is disposed in pressure-contact with the driving roller 26 across the intermediate transfer belt 25, and capable of rotating around its own axis by a driving section (not shown). In a pressure-contact portion (a transfer nip portion) between the transferring roller 30 and the driving roller 26, a toner image which has been carried by the intermediate transfer belt 25 and thereby conveyed to the pressure-contact portion is transferred onto a recording medium fed from the later-described recording medium feeding section 5. The recording medium bearing the toner image is fed to the fixing section 4. In the transferring section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a driving section (not shown), and heats the toner constituting an unfixed toner image borne on the recording medium so that the toner is fused to be fixed on the recording medium. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used, for example. The heating portion is controlled by a fixing condition controlling portion. In the vicinity of the surface of the fixing roller 31 is provided a temperature detecting sensor which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotatably driven by the rotation of the fixing roller 31. The pressure roller 32 helps the toner image to be fixed onto the recording medium by pressing the toner and the recording medium when the toner is fused to be fixed on the recording medium by the fixing roller 31. A pressure-contact portion between the fixing roller 31 and the pressure roller 32 is a fixing nip portion. In the fixing section 4, the recording medium onto which the toner image has been transferred in the transferring section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus, and the recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image borne on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus. The catch tray 41 stores the recording medium onto which the image has been fixed.

The image forming apparatus 100 includes a control unit (not shown). The control unit is disposed, for example, in an upper part of an internal space of the image forming apparatus, and contains a memory portion, a computing portion, and a control portion. To the memory portion of the control unit are inputted, for example, various set values obtained by way of an operation panel (not shown) disposed on the upper surface of the image forming apparatus, results detected from a sensor (not shown) etc. disposed in various portions inside the image forming apparatus, and image information obtained from external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus. Examples of the external equipment include a computer, a digital camera, a television set, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (abbreviated as CPU). The control unit contains a main power source as well as the above-stated processing circuit. The power source supplies electricity to not only the control unit but also respective devices provided inside the image forming apparatus.

EXAMPLES

Hereinafter, the invention will be described in detail by way of Examples and Comparative examples.

[Grid electrode Evaluation]

Example 1

Electroless plating process was performed on the surface of a grid electrode base obtained in the same manner as the grid electrode G13 fabricated in Experiment 1 described previously, thereby to constitute a grid electrode of Example 1 formed with a protective layer which was 10% in phosphorus concentration $x_1$ and was 15 μm in thickness $Z_2$ (the proportion in thickness $y_1$: 15%). In Example 1, the thickness proportion $y_1$ (=15%) of the protective layer fulfills a condition of $4 \leqq y_1 \leqq 20$ derived from the aforestated formula (4) formulated on the basis of the phosphorus concentration $x_1$ (=10%). Note that, in the electroless plating process, the grid electrode base was immersed in a plating bath composed of nickel-phosphorus dispersion liquid prepared under conditions of a pH value of 5 to 5.5 and a bath temperature of 90° C. Following the completion of the electroless plating process, the grid electrode was taken out of the plating bath, and was then subjected to water washing, pure water cleaning, and drying.

Example 2

Electroless plating process was performed on the surface of a grid electrode base similar to that of Example 1 thereby to constitute a grid electrode of Example 2 formed with a protective layer which was 10% in phosphorus concentration $x_1$, was 15% by volume in the content of PTFE fine particles, and was 15 μm in thickness $Z_2$ (the proportion in thickness $y_1$: 15%). Note that, in the electroless plating process, the grid electrode base was immersed in a plating bath composed of nickel-phosphorus dispersion liquid containing PTFE fine particles prepared under conditions of a pH value of 5 to 5.5 and a bath temperature of 90° C. Following the completion of the electroless plating process, the grid electrode was taken out of the plating bath, and was then subjected to water washing, pure water cleaning, and drying.

Example 3

Electroless plating process was performed on the surface of a grid electrode base obtained basically in the same manner as the grid electrode G13 fabricated in the aforestated Experiment 1 except that titanium was used as the material in lieu of stainless steel, thereby to constitute a grid electrode of Example 3 formed with a protective layer which was 10% in phosphorus concentration $x_1$ and was 15 μm in thickness $Z_2$ (the proportion in thickness $y_1$: 15%). The conditions of the electroless plating process were the same as in Example 1.

Example 4

On the surface of a grid electrode base similar to that of Example 1 was formed a 2 μm-thick, Ni (nickel)-made pretreatment layer by means of electrolytic plating. Next, just as was the case with Example 1, electroless plating process was performed thereon to constitute a grid electrode of Example 4 formed with a protective layer which was 10% in phosphorus concentration $x_1$ and was 15 μm in thickness $Z_2$ (the proportion in thickness $y_1$: 15%).

Example 5

On the surface of the grid electrode obtained by way of Example 4 was further formed a 0.03 μm-thick, Au (gold)-made after-treatment layer by means of electrolytic plating, whereupon a grid electrode of Example 5 was fabricated.

Comparative Example 1

Electroless plating process was performed on the surface of a grid electrode base similar to that of Example 1 thereby to constitute a grid electrode of Comparative example 1 formed with a plating layer which was 3% in phosphorus concentration $x_1$ and was 2 μm in thickness $Z_2$ (the proportion in thickness $y_1$: 2%). In Comparative example 1, the thickness proportion $y_1$ (=2%) of the protective layer does not fulfill a condition of $8.9 \leqq y_1 \leqq 24.9$ derived from the aforestated formula (4) formulated on the basis of the phosphorus concentration $x_1$ (=3%).

Comparative Example 2

Electroless plating process was performed on the surface of a grid electrode base similar to that of Example 1 thereby to constitute a grid electrode of Comparative example 2 formed with a plating layer which was 3% in phosphorus concentration, was 15% by volume in the content of PTFE fine particles, and was 2 μm in thickness (the proportion in thickness: 2%).

Note that analysis of the concentration of phosphorus in the protective layer was carried out with use of Energy-Dispersive X-ray Fluorescence Spectrometer (JSX-3201) manufactured by JEOL Ltd., and measurement of the thickness of the protective layer was carried out with use of Fluorescent X-ray Coating Thickness Gauge (SFT-3200) manufactured by Seiko instruments Inc.

<Discharge Test 1>

With use of the grid electrodes of Examples 1 to 5 and the grid electrodes of Comparative examples 1 and 2 as grid electrodes for a charging apparatus of a commercially-available image forming apparatus (product name: MX2700 manufactured by SHARP CORPORATION), the following test was conducted. As a severe condition test, an aging test was carried out under a high-humidity circumstance (at humidity of 80% or above). In this test, the charged potential on the surface of the photoreceptor was initially set at −600 V. Half-tone image evaluation was conducted for every 1000-copies printing, and how much white streaks have appeared upon printing of 10000 copies was checked by visual examination. Moreover, the surface of the grid electrode was visually observed following discharge to assess the extent of green rust developed thereon according to the same criteria as adopted in the aforestated Experiment 1. Further, duration of discharge time and a rise in potential were also evaluated. Duration of discharge time means the time spent in discharge (ks) for the electrodes attached within the apparatus. Moreover, a rise in potential was obtained by actual measurement of the value of potential elevation after discharge time with respect to an initial charged potential. Potential rise evaluation was conducted according to the same criteria as adopted in the aforestated Experiment 1 for potential elevation assessment.

The result of evaluation is shown in Table 3. It will be apparent from Table 3 that, in the image forming apparatus having the charging apparatus in which is disposed the grid electrode of Comparative example 1, 2 formed with the protective layer whose phosphorus concentration and thickness proportion each fall out of the range specified in the invention, green rust appears heavily on the surface of the grid electrode, and also there is a considerable degree of potential elevation. In contrast, in the image forming apparatus having the charging apparatus in which is disposed the grid electrode of Example 1 to 5, occurrence of green rust on the surface of the grid electrode can be suppressed, and there is little potential elevation.

As will be understood from the foregoing, in the grid electrode having the nickel/phosphorus-made protective layer whose phosphorus concentration and thickness proportion each fall within the specified range, its surface can be protected from corrosion caused by water content in the air, and ozone and nitrogen oxide and the like generated through discharge, and thereby deterioration in charged potential stability in the grid electrode can be suppressed. This makes it possible to maintain the charged-potential control capability of the grid electrode for a longer period of time, and thereby keep the charged potential on the surface of the photoreceptor in an adequate range for a longer period of time.

[Needle-Like Electrode Evaluation]

Example 6

Electroless plating process was performed on the surface of a needle-like electrode base obtained in the same manner as the needle-like electrode H13 fabricated in Experiment 2 described previously, thereby to constitute a needle-like electrode of Example 6 formed with a protective layer which was 10% in phosphorus concentration $x_2$ and was 15 μm in thickness $Z_4$ (the proportion in thickness $y_2$: 15%). In Example 6, the thickness proportion $y_2$ (=15%) of the protective layer fulfills a condition of $4 \leqq y_2 \leqq 20$ derived from the aforestated formula (5) formulated on the basis of the phosphorus concentration $x_2$ (=10%). Note that, in the electroless plating process, the needle-like electrode base was immersed in a plating bath composed of nickel-phosphorus dispersion liquid prepared under conditions of a pH value of 5 to 5.5 and a bath temperature of 90° C. Following the completion of the electroless plating process, the needle-like electrode was taken out of the plating bath, and was then subjected to water washing, pure water cleaning, and drying.

Example 7

Electroless plating process was performed on the surface of a needle-like electrode base similar to that of Example 6 thereby to constitute a needle-like electrode of Example 7 formed with a protective layer which was 10% in phosphorus concentration $x_2$, was 15% by volume in the content of PTFE fine particles, and was 15 μm in thickness $Z_4$ (the proportion in thickness $y_2$: 15%). Note that, in the electroless plating process, the needle-like electrode base was immersed in a

TABLE 3

| | Grid electrode | | Protective layer | | | | | | Discharge test | | | |
|---|---|---|---|---|---|---|---|---|---|---|---|---|
| | Material | Thickness ($Z_1$) (mm) | Phosphorus concentration ($x_1$) (%) | Thickness ($Z_2$) (μm) | Thickness proportion $y_1 = (Z_2/Z_1) \times 100$ (%) | PTFE | Conductive material for pretreatment layer | Conductive material for aftertreatment layer | Discharge time (ks) | Potential elevation (V) | Potential elevation assessment | Green rust assessment |
| Example 1 | Stainless steel | 0.1 | 10 | 15 | 15 | Absent | Absent | Absent | 242 | 8 | Good | Good/ Mediocre |
| Example 2 | Stainless steel | 0.1 | 10 | 15 | 15 | Present | Absent | Absent | 221 | 6 | Good | Good/ Mediocre |
| Example 3 | Titanium | 0.1 | 10 | 15 | 15 | Absent | Absent | Absent | 238 | 3 | Good | Good |
| Example 4 | Stainless steel | 0.1 | 10 | 15 | 15 | Absent | Ni | Absent | 270 | 14 | Good | Good/ Mediocre |
| Example 5 | Stainless steel | 0.1 | 10 | 15 | 15 | Absent | Ni | Au | 230 | 1 | Good | Good |
| Comparative example 1 | Stainless steel | 0.1 | 3 | 2 | 2 | Absent | Absent | Absent | 112 | 87 | Failure | Failure |
| Comparative example 2 | Stainless steel | 0.1 | 3 | 2 | 2 | Present | Absent | Absent | 109 | 75 | Failure | Failure |

plating bath composed of nickel-phosphorus dispersion liquid containing PTFE fine particles prepared under conditions of a pH value of 5 to 5.5 and a bath temperature of 90° C. Following the completion of the electroless plating process, the needle-like electrode was taken out of the plating bath, and was then subjected to water washing, pure water cleaning, and drying.

Example 8

Electroless plating process was performed on the surface of a needle-like electrode base obtained basically in the same manner as the needle-like electrode H13 fabricated in the aforestated Experiment 2 except that titanium was used as the material in lieu of stainless steel, thereby to constitute a needle-like electrode of Example 8 formed with a protective layer which was 10% in phosphorus concentration $x_2$ and was 15 μm in thickness $Z_4$ (the proportion in thickness $y_2$: 15%). The conditions of the electroless plating process were the same as in Example 6.

Example 9

On the surface of a needle-like electrode base similar to that of Example 6 was formed a 2 μm-thick, Ni (nickel)-made pre-treatment layer by means of electrolytic plating. Next, just as was the case with Example 6, electroless plating process was performed thereon to constitute a needle-like electrode of Example 9 formed with a protective layer which was 10% in phosphorus concentration $x_2$ and was 15 μm in thickness $Z_4$ (the proportion in thickness $y_2$: 15%).

Example 10

On the surface of the needle-like electrode obtained by way of Example 9 was further formed a 0.03 μm-thick, Au (gold)-made after-treatment layer by means of electrolytic plating, whereupon a needle-like electrode of Example 10 was fabricated.

Comparative Example 3

Electroless plating process was performed on the surface of a needle-like electrode base similar to that of Example 6 thereby to constitute a needle-like electrode of Comparative example 3 formed with a plating layer which was 3% in phosphorus concentration $x_2$ and was 2 μm in thickness $Z_4$ (the proportion in thickness $y_2$: 2%). In Comparative example 3, the thickness proportion $y_2$ (=2%) of the protective layer does not fulfill a condition of $8.9 \leqq y_2 \leqq 24.9$ derived from the aforestated formula (5) formulated on the basis of the phosphorus concentration $x_2$ (=3%).

Comparative Example 4

Electroless plating process was performed on the surface of a needle-like electrode base similar to that of Example 6 thereby to constitute a needle-like electrode of Comparative example 4 formed with a plating layer which was 3% in phosphorus concentration $x_2$, was 15% by volume in the content of PTFE fine particles, and was 2 μm in thickness $Z_4$ (the proportion in thickness $y_2$: 2%).

With use of the needle-like electrodes of Examples 6 to 10 and the needle-like electrodes of Comparative examples 3 and 4 as discharging electrodes for a charging apparatus of a commercially-available image forming apparatus (product name: MX2700 manufactured by SHARP CORPORATION), the same discharge test 1 as performed on the grid electrode was conducted. The result of evaluation is shown in Table 4. It will be apparent from Table 4 that, in the image forming apparatus having the charging apparatus in which is disposed the needle-like electrode of Comparative example 3, 4 formed with the protective layer whose phosphorus concentration and thickness proportion each fall out of the range specified in the invention, green rust appears heavily on the surface of the needle-like electrode, and also there is a considerable degree of potential elevation. In contrast, in the image forming apparatus having the charging, apparatus in which is disposed the needle-like electrode of Example 6 to 10, occurrence of green rust on the surface of the needle-like electrode can be suppressed, and there is little potential elevation.

TABLE 4

| | Needle-like electrode | | Protective layer: Phosphorus | Protective layer: Thickness | | | Protective layer: Conductive | Protective layer: Conductive | Discharge test | | | |
|---|---|---|---|---|---|---|---|---|---|---|---|---|
| | Material | Thickness ($Z_3$) (mm) | concentration ($x_2$) (%) | Thickness ($Z_4$) (μm) | proportion $y_2 = (Z_4/Z_3) \times 100$ (%) | PTFE | material for pre-treatment layer | material for after-treatment layer | Discharge time (ks) | Potential elevation (V) | Potential elevation assessment | Green rust assessment |
| Example 6 | Stainless steel | 0.1 | 10 | 15 | 15 | Absent | Absent | Absent | 238 | 10 | Good | Good/ Mediocre |
| Example 7 | Stainless steel | 0.1 | 10 | 15 | 15 | Present | Absent | Absent | 217 | 9 | Good | Good/ Mediocre |
| Example 8 | Titanium | 0.1 | 10 | 15 | 15 | Absent | Absent | Absent | 256 | 5 | Good | Good |
| Example 9 | Stainless steel | 0.1 | 10 | 15 | 15 | Absent | Ni | Absent | 262 | 19 | Good | Good/ Mediocre |
| Example 10 | Stainless steel | 0.1 | 10 | 15 | 15 | Absent | Ni | Au | 224 | 2 | Good | Good |
| Comparative example 3 | Stainless steel | 0.1 | 3 | 2 | 2 | Absent | Absent | Absent | 133 | 90 | Failure | Failure |
| Comparative example 4 | Stainless steel | 0.1 | 3 | 2 | 2 | Present | Absent | Absent | 126 | 81 | Failure | Failure |

As will be understood from the foregoing, in the needle-like electrode having the nickel/phosphorus-made protective layer whose phosphorus concentration and thickness proportion each fall within the specified range, the surface of the needle-like electrode can be protected from corrosion caused by water content in the air, and ozone and nitrogen oxide and the like generated through discharge, and thereby deterioration in charged potential stability in the needle-like electrode can be suppressed. This makes it possible to maintain the applied-voltage control capability of the needle-like electrode for a longer period of time, and thereby keep the charged potential on the surface of the photoreceptor in an adequate range for a longer period of time.

Moreover, in the image forming apparatus having the charging apparatus in which is disposed the needle-like electrode of Comparative example 3, 4, in the absence of needle-like-electrode cleaning effected by the cleaning member, white streaks and black streaks were visually observed in half-tone images after printing of 10000 copies. In contrast, in the image forming apparatus having the charging apparatus in which is disposed the needle-like electrode of Example 6 to 10, even in the absence of needle-like-electrode cleaning effected by the cleaning member, half-tone images were found to be uniform in quality without taking on unevenness even after printing of 10000 copies. Further, it has been confirmed that, in the image forming apparatus having the charging apparatus in which is disposed the needle-like electrode of Example 7, the surface of the needle-like electrode is characterized by incurring lesser amount of adherents such as dusts suspended in the air, wherefore adherents on the surface of the needle-like electrode can be removed easily at the time of cleaning effected by the cleaning member. This is because, since the needle-like electrode of Example 7 has a protective layer containing PTFE fine particles, it follows that adherability of adherents to the surface of the needle-like electrode is kept small.

[Grid Electrode-Needle-Like Electrode Combination Evaluation]

Example 11

With use of the grid electrode of Example 1 and the needle-like electrode of Example 6 as a grid electrode and a discharging electrode, respectively, for a charging apparatus of a commercially-available image forming apparatus (product name: MX2700 manufactured by SHARP CORPORATION), the aforestated discharge test 1 was conducted.

Comparative Example 5

With use of the grid electrode of Comparative example 1 and the needle-like electrode of Comparative example 3 as a grid electrode and a discharging electrode, respectively, for a charging apparatus of a commercially-available image forming apparatus (product name: MX2700 manufactured by SHARP CORPORATION), the aforestated discharge test 1 was conducted.

The result of evaluation is shown in Table 5. It will be apparent from Table 5 that, in the image forming apparatus having the charging apparatus in which are disposed the grid electrode and the needle-like electrode of Comparative example 5 each formed with the protective layer whose phosphorus concentration $x_3$ and thickness proportion $y_3$ each fall out of the range specified in the invention, green rust appears heavily on the surfaces of the grid electrode and the needle-like electrode, and also there is a considerable degree of potential elevation. In contrast, in the image forming apparatus having the charging apparatus in which are disposed the grid electrode and the needle-like electrode of Example 11, occurrence of green rust on the surfaces of the grid electrode and the needle-like electrode can be suppressed, and there is little potential elevation.

TABLE 5

| | Grid electrode and Needle-like electrode | | Protective layer | | | | | | Discharge test | | | |
|---|---|---|---|---|---|---|---|---|---|---|---|---|
| | Material | Thickness ($Z_5$) (mm) | Phosphorus concentration ($x_3$) (%) | Thickness ($Z_6$) (μm) | Thickness proportion $y_3 = (Z_6/Z_5) \times 100$ (%) | PTFE | Conductive material for pretreatment layer | Conductive material for aftertreatment layer | Discharge time (ks) | Potential elevation (V) | Potential elevation assessment | Green rust assessment |
| Example 11 | Stainless steel | 0.1 | 10 | 15 | 15 | Absent | Absent | Absent | 242 | 8 | Good | Good/ Mediocre |
| Comparative example 5 | Stainless steel | 0.1 | 3 | 2 | 2 | Absent | Absent | Absent | 112 | 89 | Failure | Failure |

As will be understood from the foregoing, in the grid electrode, as well as the needle-like electrode, having the nickel/phosphorus-made protective layer whose phosphorus concentration and thickness proportion each fall within the specified range, their surfaces can be protected from corrosion caused by water content in the air, and ozone and nitrogen oxide and the like generated through discharge, and thereby deterioration in charged potential stability in each of the grid electrode and the needle-like electrode can be suppressed. This makes it possible to maintain the charged-potential control capability of the grid electrode and the applied-voltage control capability of the needle-like electrode for a longer period of time, and thereby keep the charged potential on the surface of the photoreceptor in an adequate range for a longer period of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the grid electrode having a protective layer made of nickel and phosphorus for surface protection formed at least on its one surface, the protective layer fulfilling a following formula (1) and a condition of $8 \leqq x_1 \leqq 15$, $$(-0.7x_1+11) \leqq y_1 \leqq (-0.7x_1+27) \quad (1),$$

where a concentration of phosphorus in the protective layer is defined as $x_1$ (%) and a proportion of a one-surface thickness of the protective layer $Z_2$ to a thickness of the grid electrode $Z_1$ given as $(Z_2/Z_1)\times 100$ is defined as $y_1$ (%).

2. The charging apparatus of claim 1, wherein the protective layer contains fluorinated organic fine particles.

3. The charging apparatus of claim 1, wherein at least one of the grid electrode and the discharging electrode is made of a metal material including stainless steel or titanium.

4. The charging apparatus of claim 1, further comprising a pre-treatment layer interposed between the grid electrode and the protective layer, the pre-treatment layer being made of a conductive material that is formed by means of plating.

5. The charging apparatus of claim 1, further comprising an after-treatment layer formed on the protective layer so as to cover the protective layer therewith, the after-treatment layer being made of a conductive material that is formed by means of plating.

6. An image forming apparatus comprising:

a photoreceptor, on a surface of which is formed an electrostatic charge image;

the charging device of claim 1 for charging the surface of the photoreceptor;

an exposure section for forming an electrostatic charge image by applying signal light corresponding to image information to the surface of the photoreceptor in a charged state;

a developing section for forming a toner image by developing the electrostatic charge image borne on the surface of the photoreceptor;

a transfer section for transferring the toner image onto a recording material; and a fixing section for fixing the toner image transferred onto the recording material into place.

7. A charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the discharging electrode having a protective layer made of nickel and phosphorus for surface protection formed at least on its one surface, the protective layer fulfilling a following formula (2) and a condition of $8 \leqq x_2 \leqq 15$, $$(-0.7x_2+11) \leqq y_2 \leqq (-0.7x_2+27) \quad (2),$$

where a concentration of phosphorus in the protective layer is defined as $x_2$ (%) and a proportion of a one-surface thickness of the protective layer $Z_4$ to a thickness of the discharging electrode $Z_3$ given as $(Z_4/Z_3)\times 100$ is defined as $y_2$ (%).

8. The charging apparatus of claim 7, wherein the protective layer contains fluorinated organic fine particles.

9. The charging apparatus of claim 7, wherein at least one of the grid electrode and the discharging electrode is made of a metal material including stainless steel or titanium.

10. The charging apparatus of claim 7, further comprising a pre-treatment layer interposed between the discharging electrode and the protective layer, the pre-treatment layer being made of a conductive material that is formed by means of plating.

11. The charging apparatus of claim 7, further comprising an after-treatment layer formed on the protective layer so as to cover the protective layer therewith, the after-treatment layer being made of a conductive material that is formed by means of plating.

12. An image forming apparatus comprising:

a photoreceptor, on a surface of which is formed an electrostatic charge image;

the charging device of claim 7 for charging the surface of the photoreceptor;

an exposure section for forming an electrostatic charge image by applying signal light corresponding to image information to the surface of the photoreceptor in a charged state;

a developing section for forming a toner image by developing the electrostatic charge image borne on the surface of the photoreceptor;

a transfer section for transferring the toner image onto a recording material; and a fixing section for fixing the toner image transferred onto the recording material into place.

13. A charging apparatus comprising:

a discharging electrode for applying a voltage to a surface of a photoreceptor so as to electrically charge the surface of the photoreceptor; and a grid electrode disposed between the discharging electrode and the photoreceptor, for controlling a charged potential on the surface of the photoreceptor, the discharging electrode, as well as the grid electrode, having a protective layer made of nickel and phosphorus for surface protection formed at least on its one surface, the protective layer fulfilling a following formula (3) and a condition of $8 \leqq x_3 \leqq 15$, $$(-0.7x_3+11) \leqq y_3 \leqq (-0.7x_3+27) \quad (3),$$

where a concentration of phosphorus in the protective layer is defined as $x_3$ (%) and a proportion of a one-surface thickness of the protective layer $Z_6$ to a thickness of the discharging electrode $Z_5$, as well as a thickness of the grid electrode $Z_5$, given as $(Z_6/Z_5)\times 100$ is defined as $y_3$ (%).

14. The charging apparatus of claim 13, wherein the protective layer contains fluorinated organic fine particles.

15. The charging apparatus of claim 13, wherein at least one of the grid electrode and the discharging electrode is made of a metal material including stainless steel or titanium.

16. The charging apparatus of claim 13, further comprising a pre-treatment layer interposed between the grid electrode and the protective layer, as well as between the discharging electrode and the protective layer, the pre-treatment layer being made of a conductive material that is formed by means of plating.

17. The charging apparatus of claim 13, further comprising an after-treatment layer formed on the protective layer so as to cover the protective layer therewith, the after-treatment layer being made of a conductive material that is formed by means of plating.

18. An image forming apparatus comprising:

a photoreceptor, on a surface of which is formed an electrostatic charge image;

the charging device of claim 13 for charging the surface of the photoreceptor;

an exposure section for forming an electrostatic charge image by applying signal light corresponding to image information to the surface of the photoreceptor in a charged state;

a developing section for forming a toner image by developing the electrostatic charge image borne on the surface of the photoreceptor;

a transfer section for transferring the toner image onto a recording material; and a fixing section for fixing the toner image transferred onto the recording material into place.

* * * * *